US009650987B2

(12) United States Patent
Jiang

(10) Patent No.: US 9,650,987 B2
(45) Date of Patent: May 16, 2017

(54) WATER-COOLED INTERNAL COMBUSTION ENGINE CYLINDER HEAD AND WATER-COOLED INTERNAL COMBUSTION ENGINE EQUIPPED WITH SAME

(71) Applicants: Shanghai Jiaotong University, Shanghai (CN); Yimin Jiang, Shanghai (CN); Yaofu Jiang, Jiangsu (CN)

(72) Inventor: Yaofu Jiang, Jiangsu (CN)

(73) Assignees: Yaofu Jiang, Jiangsu (CN); Yimin Jiang, Shanghai (CN); Shanghai Jiaotong University, Shanghai (CN)

( * ) Notice: Subject to any disclaimer, the term of this patent is extended or adjusted under 35 U.S.C. 154(b) by 232 days.

(21) Appl. No.: 14/443,948

(22) PCT Filed: Nov. 12, 2013

(86) PCT No.: PCT/CN2013/086928
§ 371 (c)(1),
(2) Date: May 19, 2015

(87) PCT Pub. No.: WO2014/075603
PCT Pub. Date: May 22, 2014

(65) Prior Publication Data

US 2015/0300290 A1 Oct. 22, 2015

(30) Foreign Application Priority Data

Nov. 19, 2012 (CN) ..... 2012 1 0487054
May 7, 2013 (CN) ..... 2013 1 0184378

(51) Int. Cl.
*F02F 1/42* (2006.01)
*F02F 1/10* (2006.01)
(Continued)

(52) U.S. Cl.
CPC ..... *F02F 1/40* (2013.01); *F02F 1/24* (2013.01); *F02F 1/242* (2013.01); *F02F 1/36* (2013.01); *F02F 1/4285* (2013.01)

(58) Field of Classification Search
CPC ..... F02F 1/40; F02F 1/24; F02F 1/242; F02F 1/36; F02F 1/4285
(Continued)

(56) References Cited

FOREIGN PATENT DOCUMENTS

CN 201071766 Y 6/2008
CN 202991254 U 6/2013
(Continued)

OTHER PUBLICATIONS

International Search Report Application No. PCT/CN2013/086928 Completed: Feb. 15, 2014; Mailing Date: Feb. 20, 2014 4 pages.

*Primary Examiner* — Carlos A Rivera
*Assistant Examiner* — Syed O Hasan
(74) *Attorney, Agent, or Firm* — St. Onge Steward Johnston & Reens, LLC

(57) ABSTRACT

A cylinder head is prepared by integrating an upper cylinder head part and a lower cylinder head part, which are manufactured separately, into the whole, wherein the fuel injector receiving hole, the intake valve stem receiving hole and the exhaust valve stem receiving hole are respectively prepared by integrating their upper portions which are formed together with the upper cylinder head part and their lower portions which are formed together with the lower cylinder head part respectively; the intake duct and the exhaust duct are formed in the lower cylinder head part; the cylinder head water cavity is prepared by integrating an upper water cavity portion formed together with the upper cylinder head part and a lower water cavity portion formed together with the
(Continued)

lower cylinder head part into the whole, alternatively, the cylinder head water cavity is formed, as a whole, with the lower cylinder head part.

20 Claims, 17 Drawing Sheets

(51) Int. Cl.

| | |
|---|---|
| ***F02F 1/14*** | (2006.01) |
| ***F02F 1/36*** | (2006.01) |
| ***F02F 1/40*** | (2006.01) |
| ***F02F 1/24*** | (2006.01) |

(58) Field of Classification Search
USPC ..... 123/193.3, 193.5, 41.72, 41.82 R, 41.79
See application file for complete search history.

(56) References Cited

FOREIGN PATENT DOCUMENTS

| | | | |
|---|---|---|---|
| DE | 3030200 | A1 | 2/1982 |
| GB | 567660 | A | 2/1945 |
| GB | 1483335 | A | 8/1977 |
| JP | S56107933 | A | 8/1981 |
| JP | S62135646 | A | 6/1987 |
| JP | S62162756 | A | 7/1987 |
| JP | S62294750 | A | 12/1987 |
| JP | H0526099 | A | 2/1993 |
| JP | 2012062764 | A | 3/2012 |

A-A

B-B

A–A

E direction

A-A

B-B

A–A

C-C

B-B

WATER-COOLED INTERNAL COMBUSTION ENGINE CYLINDER HEAD AND WATER-COOLED INTERNAL COMBUSTION ENGINE EQUIPPED WITH SAME

FIELD OF THE INVENTION

The invention relates to a water-cooled internal combustion engine cylinder head, a water-cooled internal combustion engine equipped with the water-cooled cylinder head, and a machine equipped with the water-cooled internal combustion engine with the water-cooled cylinder head.

BACKGROUND OF THE INVENTION

It is known at present that a water-cooled internal combustion engine cylinder head has a cooling water cavity, for example, the specifications and their accompanying drawings of Chinese Patent ZL200720139399.7 and ZL200410082513.8 disclose a horizontal single-cylinder water-cooled diesel engine. The sectional view of the water-cooled cylinder head in the drawings of the above-said patents shows that the cooling water cavity of the cylinder head surrounds the outside walls of fuel injector receiving holes, the outside walls of intake ducts, and the outside walls of exhaust ducts, and has a complicated configuration and shape. Thus, the water-cooled cylinder head can only be formed by means of a core of the cooling water cavity. The core needs using sands and binders, and the casting process and the dust generated during breaking and removing the core may pollute the environment. Moreover, because of the complicated design configuration of the water-cooled cylinder head of the prior art, it is rather difficult to make demoulding and to take out the cores, and so it is impossible to employ die-casting process to form the cylinder head. A cylinder head, formed by die-casting process, for an air-cooled single-cylinder diesel engine is disclosed in the specification and its accompanying drawings of Chinese Patent ZL94194819.6, in which a complicated helical-shaped intake duct is formed, for the first time, by die-casting process with taking out a core section by section. Further, the specification and its accompanying drawings of patent application No. 200480042175.3 disclose a method of die-casting the whole cylinder head of an air-cooled diesel engine and the die-casting mould used in the method. At present, both the water-cooled/air-cooled internal combustion engine cylinder blocks and the air-cooled internal combustion engine cylinder heads have been manufactured in great batches by die-casting process with aluminum alloys. Now, it is necessary to create a new water-cooled cylinder head configuration and a new technical solution for making it, so as to facilitate mass production of the water-cooled cylinder heads by die-casting process while meeting the requirements to ensure the functions which the water-cooled internal combustion engine cylinder head should have. Furthermore, the new technical solution should be reliable, simple and practical in production, better economical, energy-saving, environmentally-friendly, and easy to realize mass production.

SUMMARY OF THE INVENTION

In the water-cooled cylinder heads of the prior art, cooling water cavity is provided within the cylinder head. A fuel injector receiving hole as well as intake and exhaust ducts are surrounded by the cooling water cavity, and the intake and exhaust ducts have such complicated shapes that it is almost impossible to design die-casting moulds for them and impossible to manufacture water-cooled cylinder heads by use of die-casting, demoulding and drawing-core-out processes. In order to manufacture water-cooled cylinder heads with complicated-shaped curved helical intake and exhaust ducts, especially to successfully manufacture water-cooled cylinder heads of multi-cylinder internal combustion engines by conventional die casting, demoulding and drawing-core-out processes, in the present invention, there is provided a cylinder head and its manufacture method in which a water-cooled cylinder head to be manufactured is divided into two or more parts (pieces) to be manufactured separately, and then the parts are integrated to form the whole cylinder head. Such a water-cooled cylinder head and its manufacture method can fully take the advantages of the existing conventional manufacture processes such as die-casting, extrusion, forging, stamping, welding, adhering, bolting and riveting separately or in combination, and can facilitate realizing mass production of cylinder heads with reliable quality, and will be convenient, economic, energy-saving and environmentally-friendly.

In the present invention, it provides the following technical solution: a water-cooled cylinder head to be manufactured is divided into two cylinder head parts, said cylinder head 80 comprising: an intake duct 887, an exhaust duct 889, a cylinder head water cavity 83, a fuel injector receiving hole 876, an intake valve stem receiving hole 8812, and an exhaust valve stem receiving hole 8822, characterized in that, said cylinder head 80 is formed by integrating an upper cylinder head part 87 and a lower cylinder head part 88, which are manufactured separately, into the whole, wherein said fuel injector receiving hole 876, said intake valve stem receiving hole 8812 and said exhaust valve stem receiving hole 8822 are respectively formed by integrating their upper portions which are formed together with said upper cylinder head part 87 and their lower portions which are formed together with said lower cylinder head part 88 respectively; said intake duct 887 and said exhaust duct 889 are formed in said lower cylinder head part 88; said cylinder head water cavity 83 is formed by integrating an upper water cavity portion which is formed together with said upper cylinder head part 87 and a lower water cavity portion which is formed together with said lower cylinder head part 88 into the whole, alternatively, said cylinder head water cavity 83 is formed, as a whole, together with said lower cylinder head part 88.

The upper cylinder head part 87 and the lower cylinder head part 88 can be integrated into the cylinder head 80 by processes such as welding, adhering, bolting and riveting.

In one embodiment that the upper cylinder head part 87 and lower cylinder head part 88 are integrated into the cylinder head 80 by welding at all of the joints, joining and sealing between the two parts are attained by welding. The joints between the upper cylinder head part 87 and lower cylinder head part 88 do not need to be applied with any adhesive sealants.

In one embodiment that the upper cylinder head part 87 and lower cylinder head part 88 are integrated into the cylinder head 80 by adhering, bolting and/or riveting, it is necessary to apply adhesive sealant to the joints. If welding, adhering, bolting and/or riveting are employed in combination to integrate the upper and lower cylinder head parts 87 and 88, it is unnecessary for some welds to be applied with adhesive sealant.

In one embodiment of employing welding, for example, the joint between the fuel injector receiving hole's upper portion in said upper cylinder head part and the fuel injector receiving hole's lower portion in said lower cylinder head part is provided with a fuel injector receiving hole's O-ring sealing groove 885 around the hole; the joint between the intake valve stem receiving hole's upper portion in said upper cylinder head part and the intake valve stem receiving hole's lower portion in said lower cylinder head part is provided with an intake valve stem receiving hole's O-ring sealing groove 872 around the hole; the joint between the exhaust valve stem receiving hole's upper portion in said upper cylinder head part and the exhaust valve stem receiving hole's lower portion in said lower cylinder head part is provided with an exhaust valve stem receiving hole's O-ring sealing groove 873 around the hole; said upper cylinder head part 87 is provided with upper cylinder head part's bolt holes 871, and said lower cylinder head part 88 is provided with lower cylinder head part's bolt holes 881, at the joint between said cylinder head bolt holes 871 and said cylinder head bolt holes 881 and inside the edges of the upper cylinder head part' bolt holes 871 and said lower cylinder head part' bolt holes 881 and around said cylinder head water cavity 83 is provided with a water cavity's endless O-ring sealing groove 883; O-rings are provided in said fuel injector receiving hole's O-ring sealing groove 885, said intake valve stem receiving hole's O-ring sealing groove 872, said exhaust valve stem receiving hole's O-ring sealing groove 873, and said water cavity's O-ring sealing groove 883, respectively, along the periphery of the parting surface between said upper cylinder head part 87 and said lower cylinder head part 88 is provided an endless weld 803, said upper cylinder head part 87 and said lower cylinder head part 88 are integrated into said cylinder head 80 by said weld 803.

In one embodiment of employing adhering, for example, the joint between the fuel injector receiving hole's upper portion in said upper cylinder head part and the fuel injector receiving hole's lower portion in said lower cylinder head part is applied with an adhesive sealant; the joint between the intake valve stem receiving hole's upper portion in said upper cylinder head part and the intake valve stem receiving hole's lower portion in said lower cylinder head part is applied with an adhesive sealant; the joint between the exhaust valve stem receiving hole's upper portion in said upper cylinder head part and the exhaust valve stem receiving hole's lower portion in said lower cylinder head part is applied with an adhesive sealant; said upper cylinder head part 87 is provided with upper cylinder head part' bolt holes 871, and said lower cylinder head part 88 is provided with lower cylinder head part' bolt holes 881, the joints between said upper cylinder head part' bolt holes 871 and said lower cylinder head part' bolt holes 881 are applied with an adhesive sealant; in the parting surface between said upper cylinder head part 87 and said lower cylinder head part 88 and around said cylinder head water cavity 83 there is applied with an adhesive sealant, and said upper cylinder head part 87 and said lower cylinder head part 88 are integrated into said cylinder head 80 by the adhesive sealant.

In one embodiment of employing bolts, for example, the joint between the fuel injector receiving hole's upper portion in said upper cylinder head part and the fuel injector receiving hole's lower portion in said lower cylinder head part is provided with a fuel injector receiving hole's O-ring sealing groove 885 around the hole; the joint between the intake valve stem receiving hole's upper portion in said upper cylinder head part and the intake valve stem receiving hole's lower portion in said lower cylinder head part is provided with an intake valve stem receiving hole's O-ring sealing groove 872 around the hole; the joint between the exhaust valve stem receiving hole's upper portion in said upper cylinder head part and the exhaust valve stem receiving hole's lower portion in said lower cylinder head part is provided with an exhaust valve stem receiving hole's O-ring sealing groove 873 around the hole; said upper cylinder head part 87 is provided with upper cylinder head part's bolt holes 871, and said lower cylinder head part 88 is provided with lower cylinder head part's bolt holes 881, at the joint between said cylinder head bolt holes 871 and said cylinder head bolt holes 881 and inside the edges of the upper cylinder head part' bolt holes 871 and said lower cylinder head part' bolt holes 881 and around said cylinder head water cavity 83 is provided a water cavity' endless O-ring sealing groove; O-rings are provided in said fuel injector receiving hole's O-ring sealing groove 885, said intake valve stem receiving hole's O-ring sealing groove 872, said exhaust valve stem receiving hole's O-ring sealing groove 873, and said water cavity's O-ring sealing groove 883, respectively, said upper cylinder head part 87 is provided with counterbores 8713 for tubular bolts 8710 inserted therethrough, said lower cylinder head part' bolt holes 881 are provided with inner threads for said tubular bolts 8710 screwing thereinto; cylinder head bolts 74 can be inserted through the axial center holes 8711 of said tubular bolts 8710, said tubular bolts 8710 are inserted through said counterbores 8713 and screw into said inner threads of said lower cylinder head part' bolt holes 881, said upper cylinder head part 87 and said lower cylinder head part 88 are integrated into said cylinder head 80 by said tubular bolts 8710.

In one embodiment of employing rivets, for example, the joint between the fuel injector receiving hole's upper portion in said upper cylinder head part and the fuel injector receiving hole's lower portion in said lower cylinder head part is provided with a fuel injector receiving hole's O-ring sealing groove 885 around the hole; the joint between the intake valve stem receiving hole's upper portion in said upper cylinder head part and the intake valve stem receiving hole's lower portion in said lower cylinder head part is provided with an intake valve stem receiving hole's O-ring sealing groove 872 around the hole; the joint between the exhaust valve stem receiving hole's upper portion in said upper cylinder head part and the exhaust valve stem receiving hole's lower portion in said lower cylinder head part is provided with an exhaust valve stem receiving hole's O-ring sealing groove 873 around the hole; said upper cylinder head part 87 is provided with upper cylinder head part's bolt holes 871, and said lower cylinder head part 88 is provided with lower cylinder head part's bolt holes 881, at the joint between said cylinder head bolt holes 871 and said cylinder head bolt holes 881 and inside the edges of the upper cylinder head part' bolt holes 871 and said lower cylinder head part' bolt holes 881 and around said cylinder head water cavity 83 is provided a water cavity' endless O-ring sealing groove; O-rings are provided in said fuel injector receiving hole's O-ring sealing groove 885, said intake valve stem receiving hole's O-ring sealing groove 872, said exhaust valve stem receiving hole's O-ring sealing groove 873, and said water cavity's O-ring sealing groove 883, respectively; tubular rivets 801 are provided in and through said upper cylinder head part's bolt holes 871 and said lower cylinder head part's bolt holes 881, cylinder head bolts 74 can be inserted through a through hole 805 of said tubular rivets 801, and said tubular rivets 801 are riveted at their two ends to said upper cylinder head part 87 and said lower cylinder head part 88 respectively, and said upper cylinder head part 87 and said lower cylinder head part 88 are riveted together by said tubular rivets 801 so as to be said cylinder head 80.

The present invention can further be applicable to the water-cooled internal combustion engine cylinder head with cam followers. In this case, said cylinder head 80 further comprises cam follower receiving holes 85, said cam follower receiving holes 85 are formed by integrating an upper portion formed together with said upper cylinder head part 87 and a lower portion formed together with said lower cylinder head part 88; alternatively, the cam follower receiving holes 85 are provided only in the lower cylinder head part 88 and there are no cam follower receiving holes 85 within the periphery of the upper cylinder head part 87.

In order to easily form a better cooling water flow space between the bottom of lower cylinder head part 88 and the intake and exhaust ducts 887 and 889 in the lower cylinder head part 88, the water-cooled cylinder head of the present invention can be further divided into three cylinder head parts which are manufactured separately. For example, said lower cylinder head part 88 is formed of an upper sub-part 8819 and a lower sub-part 8818 which are manufactured separately, there is a parting surface x8 between said lower cylinder head part's upper sub-part 8819 and said lower cylinder head part's lower sub-part 8818; said intake duct 887 has a parallel portion which is parallel in its axial direction to said parting surface x8 and a vertical portion which is perpendicular in its axial direction to said parting surface x8; said exhaust duct 889 has a parallel portion which is parallel in its axial direction to said parting surface x8 and a vertical portion which is perpendicular in its axial direction to said parting surface x8; said parting surface x8 cuts only through said intake duct's vertical portion and said exhaust duct's vertical portion; on said lower cylinder head part's upper sub-part 8819 there are both the whole inlet of said intake duct 887 and the whole outlet of said exhaust duct 889; on said lower cylinder head part's lower sub-part 8818 there are intake valve lines 8810 which axially correspond to said intake valve stem receiving hole 8812, and on said lower cylinder head part's lower sub-part 8818 there are exhaust valve lines 8820 which axially correspond to said exhaust valve stem receiving hole 8822; on said lower cylinder head part's lower sub-part 8818 there is a fuel injector receiving hole end opening 886; the joints between said lower cylinder head part's upper sub-part 8819 and said lower cylinder head part's lower sub-part 8818 are provided with O-ring sealing grooves and/or adhesive sealants, said lower cylinder head part's upper sub-part 8819 and said lower cylinder head part's lower sub-part 8818 are joined into said lower cylinder head part 88 by welding, adhering, bolting and/or riveting.

The water-cooled cylinder head of the present invention can be even further divided into four cylinder head parts which are manufactured separately. For example, in order to form the water-cooled cylinder head by die-casting process, in which the metal mould cores of curved helical intake and exhaust ducts in the water-cooled cylinder head can not be drawn out. it provides the following technical solution: said lower cylinder head part 88 is formed of a lower cylinder head part's lower sub-part 8818, a lower cylinder head part's middle sub-part 8817 and a lower cylinder head part's top sub-part 8816 all of which are manufactured separately, there is a lower cylinder head part's first parting surface x6 between said lower cylinder head part's top sub-part 8816 and said lower cylinder head part's middle sub-part 8817, and there is a lower cylinder head part's second parting surface x7 between said lower cylinder head part's middle sub-part 8817 and said lower cylinder head part's lower sub-part 8818; said intake duct 887 has a parallel portion which is parallel in its axial direction to both said lower cylinder head part's first parting surface x6 and said lower cylinder head part's second parting surface x7 and a vertical portion which is perpendicular in its axial direction to both said lower cylinder head part's first parting surface x6 and said lower cylinder head part's second parting surface x7; said exhaust duct 889 has a parallel portion which is parallel in its axial direction to both said lower cylinder head part's first parting surface x6 and said lower cylinder head part's second parting surface x7 and a vertical portion which is perpendicular in its axial direction to both said lower cylinder head part's first parting surface x6 and said lower cylinder head part's second parting surface x7; said lower cylinder head part's first parting surface x6 runs through the central line of said intake duct's parallel portion and through the central line of said exhaust duct's parallel portion, and said lower cylinder head part's second parting surface x7 runs through only the central line of said intake duct's vertical portion and through the central line of said exhaust duct's vertical portion; on said lower cylinder head part's lower sub-part 8818 there are intake valve lines 8810 which axially correspond to said intake valve stem receiving hole 8812; and on said lower cylinder head part's lower sub-part 8818 there are exhaust valve lines 8820 which axially correspond to said exhaust valve stem receiving hole 8822; said fuel injector receiving hole end opening 886 is provided on said lower cylinder head part's lower sub-part 8818; the joints at both said parting surface x6 and said parting surface x7 between said intake duct 887 sections and said exhaust duct 889 sections are provided with O-rings and/or adhesive sealants, said lower cylinder head part's top sub-part 8816, said lower cylinder head part's middle sub-part 8817 and said lower cylinder head part's lower sub-part 8818 are joined into said lower cylinder head part 88 by welding, adhering, bolting and/or riveting.

Also, the upper cylinder head part 87 can further be divided into two sub-parts which are manufactured separately. Moreover, the lower cylinder head part 88 can even be divided into five, six or more sub-parts which are manufactured separately, and all the sub-parts of upper and lower cylinder head parts 87 and 88 can be integrated to a cylinder head 80 by welding, adhering, bolting and/or riveting procedures. Because of the development in adhesive sealants, metal powders can be added thereinto. The connecting surfaces of the separated manufactured cylinder head parts do not need to be machined, while they can constitute the cylinder head 80 directly by welding, adhering, bolting and/or riveting.

In the case that a very compact cylinder head design makes it impossible to inset tubular bolts 8710 and/or tubular rivets 801 in cylinder head bolt holes, in order to integrate the cylinder head parts and sub-parts manufactured separately into a cylinder head, it is practicable to provide screw holes 888 and through holes 882 for integrating the parts and sub-parts in the positions outside both the cylinder head bolt holes 871, 881 and cam follower receiving holes 85, or it is also practicable to provide though holes for integrating the parts and sub-parts by use of ordinary rivets. After a multi-part cylinder head of the present invention is mounted on the cylinder block of an internal combustion engine, if only the cylinder head bolts are tightened evenly and reliably, even if the bolts or rivets integrating the cylinder head parts and sub-parts to the multi-part cylinder head are somehow a little loosed, the multi-part cylinder head will remains to work well without leakage.

For integrating a cylinder head 80, it is practicable to employ welding, adhering, bolting and/or riveting in combination. For example, in integrating a upper cylinder head part 87 and lower cylinder head part 88, some joints are welded, some are adhered, or bolted or riveted; it is also practicable to add bolting and/or riveting besides adhering; welding can be conducted before adhesive sealant becomes cured; it is practicable to employ adhesive sealant and O-rings in combination at the parting surfaces to realize joining and sealing.

It is practicable to integrate the cylinder head parts to a cylinder head by bolts or rivets which are inset in the cylinder head bolt holes for mounting a cylinder head onto a cylinder block. In this case, the specialized tubular bolts or tubular rivets can be used to integrate the upper and lower cylinder head parts, by inserting conventional cylinder head bolts through the center holes of the tubular bolts or rivets, a cylinder head of the present invention can be mounted onto a cylinder block in the same way as in the prior art. This allows to remain a larger water cavity space to advantageously cool the cylinder head. In the case that the cylinder head bolt holes of some cylinder heads are spaced somewhat far from one another, for the purpose to join the upper and lower cylinder head parts tightly, additional holes for bolts or rivets can be provided in the spaces between the original cylinder head bolt holes, or the cylinder head bolt holes are not selected as the holes for bolting or riveting the upper and lower cylinder head parts.

Also, an intake valve stem receiving hole guide sleeve 8811 and/or an exhaust valve stem receiving hole guide sleeve can be inset in the intake valve stem receiving hole 8812 and/or the exhaust valve stem receiving hole 8822 respectively. If so, it is advantageous to realize the positioning, joining, fastening and sealing between the upper and lower cylinder head parts.

The cylinder head gasket between a cylinder head and a cylinder block, in addition to sealing the air and/or gas within a cylinder, has significant influence on the combustion efficiency of an internal combustion engine because of its thickness stability when it is pressed tightly. For this reason, in the present invention, a boss 8815 is provided around the end opening of the screw hole 881 in the lower cylinder head part 88. The gasket is pressed tightly between the bosses 8815 and the cylinder block end face, and the height of the bosses is less than the thickness of the gasket, the difference therebetween will ensure elastic deformation of the cylinder head gasket to be stable in the range of optimal design values when cylinder head bolts are fastened properly.

Similarly, bosses 8814 for riveting are provided around the end openings of the though holes 805 of the tubular rivets 801 in the planer bottom surface of the lower cylinder head part. The planer bottom surface is machined before the upper and lower cylinder head parts are riveted together, so that the bosses 8814 will ensure elastic deformation of the cylinder head gasket to be stable in the range of optimal design values when cylinder head bolts are fastened properly.

It is practicable to provide a water hole 830 and a blind water hole 840 in the planer bottom surface of the lower cylinder head part 88, and to make the former directly communicate to the cylinder head water cavity 83 and the latter not communicate to the same. It is also practicable to provide a channel 850 in the planer bottom surface of the lower cylinder head part 88 and to make it communicate the water hole 830 with the blind water hole 840.

In the planer bottom surface of the lower cylinder head part 88 is also provided an endless channel 850 which makes the water hole 81, the water hole 830 and the blind water hole 840 communicate with each other, this is advantageous to directly cool partial gasket surfaces around the internal combustion engine cylinder liner.

The water hole between the intake and exhaust ducts 887 and 889 and the bottom surface of the lower cylinder head part 88 can be designed to be partially communicated to and partially not communicated to the cylinder head water cavity 83 so as to have an endless cooling channel between the bottom surface of the lower cylinder head part 88 and a cylinder head gasket and to cool both the cylinder head and cylinder head gasket even better.

The upper cylinder head part 87 can be manufactured by use of a metal plate, this is advantageous to improve the cylinder head strength and to reduce its production cost. In this case, the whole cylinder head water cavity 83 is formed in the lower cylinder head part 88. Different parts of a cylinder head can be made of different materials because they can be manufactured separately, thereby production cost can be reduced further.

After a multi-part cylinder head of the present invention is mounted on a cylinder block of an internal combustion engine, the cylinder head bolts screwed into the cylinder block will have steady fastening toque which can ensure reliable integration and sealing between the upper and lower cylinder head parts for a long time. In the case that the joining surface between the upper and lower cylinder head parts does not have an area for providing cylinder head bolt holes, it is practicable to have only the lower cylinder head part to be directly fastened by cylinder head bolts to a cylinder block without making the cylinder head bolts in contact with the upper cylinder head part. In this case, it is also possible to join the upper and lower cylinder head parts into a cylinder head by welding, adhering, bolting and/or riveting. However, in view that the joining and sealing between the upper and lower cylinder head parts should be reliable for a long time, the fastening forces of cylinder head bolts to fasten a cylinder head to a cylinder block should be even and reliable, and cylinder head bolt holes should be arranged evenly and rationally. A reasonable selection is to employ bolts or rivets through the cylinder head bolt holes to integrate the upper and lower cylinder head parts, this measure will have no influence on design of other functions of the cylinder head.

A water-cooled internal combustion engine comprises a cylinder block 70 and a piston 20, and characterized in that on the cylinder block 70 is mounted a cylinder head 80 as defined in any one of the technical solutions described above.

A machine is equipped with a water-cooled internal combustion engine as defined above, and characterized in that the cylinder head 80 as defined in any one of the technical solutions described above is mounted on the cylinder block 70 of the machine.

Furthermore, according to one embodiment of the present invention, a water-cooled internal combustion engine cylinder head 80 comprises an intake duct 887, an exhaust duct 889, a cylinder head water cavity 83, a fuel injector receiving hole 876, an intake valve stem receiving hole 8812, an exhaust valve stem receiving hole 8822, and cam follower receiving holes 85, said cylinder head 80 is formed by integrating said upper cylinder head part 87 and said lower cylinder head part 88 which are manufactured separately into the whole, said upper cylinder head part 87 is provided with through holes for inserting therethrough the fuel injector receiving hole portion 876, the intake valve stem receiving hole portion 8812 and the exhaust valve stem receiving hole portion 8822, respectively, all of which are formed together with said lower cylinder head part 88, and said lower cylinder head part 88 is provided with the intake duct 887, the exhaust duct 889, the cylinder head water cavity 83, the fuel injector receiving hole 876, the intake valve stem receiving hole 8812 and the exhaust valve stem receiving hole 8822; said cam follower receiving holes 85 are formed of an upper portion formed together with said upper cylinder head part 87 and a lower portion formed together with said lower cylinder head part 88; around the periphery of the parting surface between said upper cylinder head said part 87 and said lower cylinder head part 88 is provided an endless weld 8030 which runs inside of the cylinder head bolt holes; at the joint between said fuel injector receiving hole 876 which is formed together with said lower cylinder head part 88 and the corresponding through hole in said upper cylinder head part 87 is provided a weld 8031; at the joint between said intake valve stem receiving hole 8812 which is formed together with said lower cylinder head part 88 and the corresponding through hole in said upper cylinder head part 87 is provided a weld 8032; at the joint between said exhaust valve stem receiving hole 8822 which is formed together with said lower cylinder head part 88 and the corresponding through hole in said upper cylinder head part 87 is provided a weld 8033, and at the parting surface between said upper cylinder head part 87 and said lower cylinder head part 88 and around said cam follower receiving holes 85 are provided welds 8034, said upper cylinder head part 87 and said lower cylinder head part 88 are integrated into said cylinder head 80 by said weld 8030, said weld 8031, said weld 8032, said weld 8033, and said weld 8034.

Furthermore, according to one embodiment of the present invention, a water-cooled internal combustion engine cylinder head 80 comprises an intake duct 887, an exhaust duct 889, a cylinder head water cavity 83, a fuel injector receiving hole 876, an intake valve stem receiving hole 8812, an exhaust valve stem receiving hole 8822, and cam follower receiving holes 85, said cylinder head 80 is formed by integrating said upper cylinder head part 87 and said lower cylinder head part 88 which are manufactured separately into the whole, said upper cylinder head part 87 is provided with through holes for inserting therethrough the fuel injector receiving hole portion 876, the intake valve stem receiving hole portion 8812, the exhaust valve stem receiving hole portion 8822 and the cylinder head bolt hole portions 871, respectively, all of which are formed together with said lower cylinder head part 88, and said lower cylinder head part 88 is provided with the intake duct 887, the exhaust duct 889, the cylinder head water cavity 83, the fuel injector receiving hole 876, the cylinder head bolt hole portions 871, the intake valve stem receiving hole portion 8812 and the exhaust valve stem receiving hole portion 8822; said cam follower receiving holes 85 are formed of an upper portion formed together with said upper cylinder head part 87 and a lower portion formed together with said lower cylinder head part 88; around the periphery of the parting surface between said upper cylinder head said part 87 and said lower cylinder head part 88 is provided an endless weld 803; at the joint between said fuel injector receiving hole 876 which is formed together with said lower cylinder head part 88 and the corresponding through hole in said upper cylinder head part 87 is provided a weld 8031; at the joint between said intake valve stem receiving hole 8812 which is formed together with said lower cylinder head part 88 and the corresponding through hole in said upper cylinder head part 87 is provided a weld 8032; at the joint between said exhaust valve stem receiving hole 8822 which is formed together with said lower cylinder head part 88 and the corresponding through hole in said upper cylinder head part 87 is provided a weld 8033; and at the parting surface between said upper cylinder head part 87 and said lower cylinder head part 88 and around said cam follower receiving holes 85 are provided welds 8034; at the joints between said cylinder head bolt holes 871 and the corresponding through holes in said upper cylinder head part 87 are provided welds 8035, and said upper cylinder head part 87 and said lower cylinder head part 88 are integrated into said cylinder head 80 by said weld 803, said weld 8031, said weld 8032, said weld 8033, said weld 8034 and said weld 8035.

Moreover, the outside wall of the cylinder head 80 can be provided with though holes 8762 for taking out the mould cores and sealing plugs 8763 which correspond to the die-casting demoulding blind areas of the fuel injector receiving hole 876, intake duct 887 and exhaust duct 889.

A water-cooled internal combustion engine according to still another embodiment of the present invention comprises a cylinder block 70 and a cylinder head 80 which is defined as in any one of the embodiments described above.

The present invention is applicable to water-cooled single-cylinder or multi-cylinder internal combustion engine cylinder heads and the internal combustion engines equipped with such cylinder heads, and applicable to horizontal or vertical water-cooled internal combustion engine cylinder heads and the internal combustion engines equipped with such cylinder heads. The advantages of the present invention are as follows. A cylinder head is divided into an upper cylinder head part and a lower cylinder head part which are manufactured separately, and even the upper cylinder head part and/or lower cylinder head part can be further divided into more cylinder head sub-parts which are manufactured separately, and then the separately manufactured cylinder head parts are integrated to the whole cylinder head (if the upper cylinder head part and/or the lower cylinder head part are further divided into subparts, then the subparts shall be firstly joined to constitute the upper cylinder head part and/or the lower cylinder head part). The cylinder head parts and sub-parts can be easily and simply manufactured by die-casting process with easily demoulding and drawing out the mould cores. Thus, it is practicable to form an internal combustion engine cylinder head by die-casting process. In the case that both the intake duct and the exhaust duct are divided into halves and the two halves are manufactured together with the cylinder head parts manufactured separately by die-casting process, complicated-shaped curved helical intake and exhaust ducts can be easily realized. The separately manufactured cylinder head parts will be reliable in quality, simple in manufacture process, convenient in assembly and much better in economy. By providing an endless cooling water channel between the planer bottom surface of a cylinder head and the cylinder head gasket, it can enhance the cooling effect of both the cylinder head and the gasket. Because the cylinder head of the present invention is integrated by its parts and/or sub-parts and their casting process does not need any sand-moulds and cores which are necessary in the existing art, the manufacture process of the cylinder head of the present invention is environmentally friendly. Further, the cylinder head of the present invention can be formed by die-casting process, thereby employing some lighter metal materials which reduce the weight of the cylinder head and the internal combustion engines assembled therewith, even reducing the weight of vehicles and their fuel consumption and being environmentally friendly.

These and other advantages and features of the present invention will become apparent in the detailed description hereinafter.

BRIEF DESCRIPTION OF THE ACCOMPANYING DRAWINGS

The present invention is now described in detail by embodiments with reference to the accompanying drawings.

Figure 1:
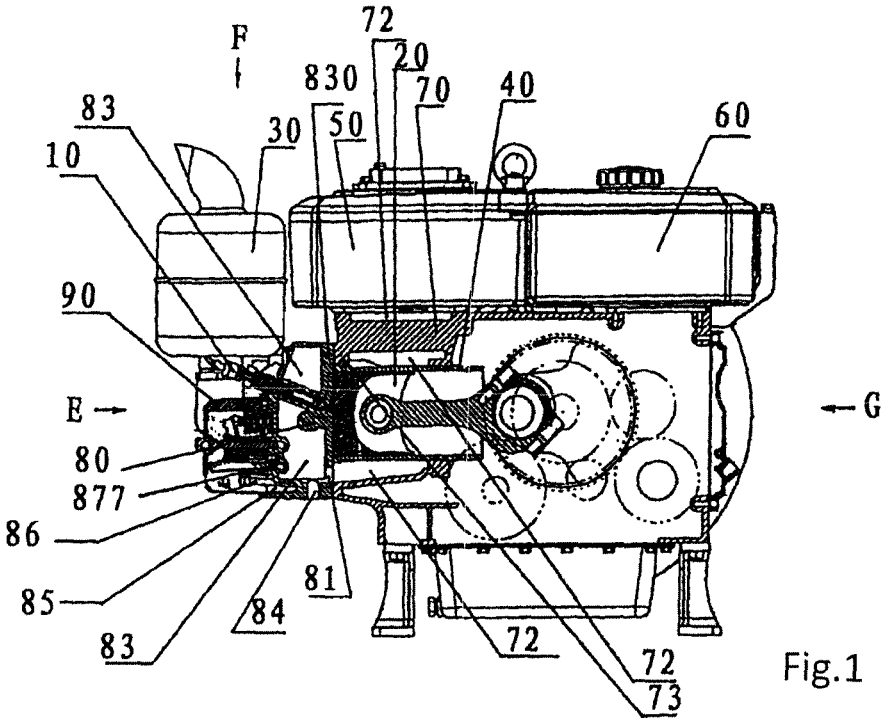
FIG. 1 is a sectional view of a water-cooled single-cylinder internal combustion engine.
Figure 2:
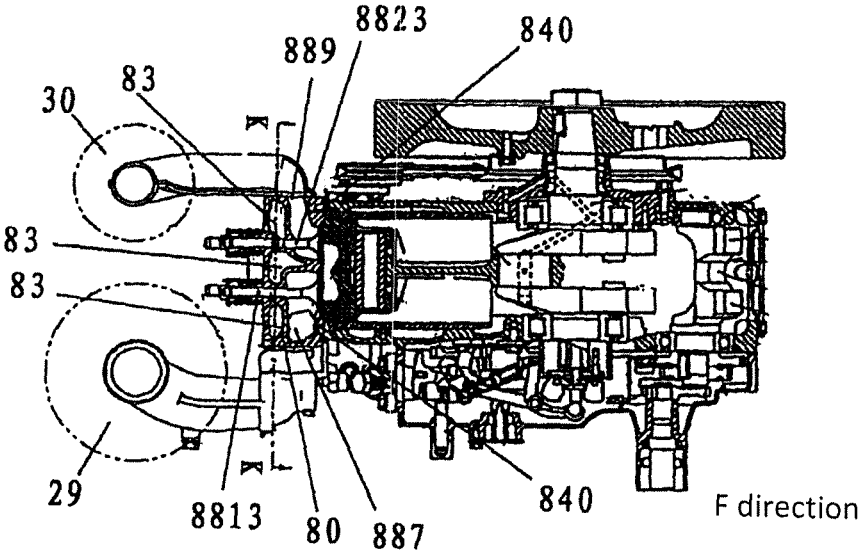
FIG. 2 is a sectional view of a water-cooled single-cylinder internal combustion engine which is equipped with a cylinder head of an embodiment according to the present invention; it is viewed in the direction F in FIG. 1, wherein it shows a parting surface k-k.
Figure 4:
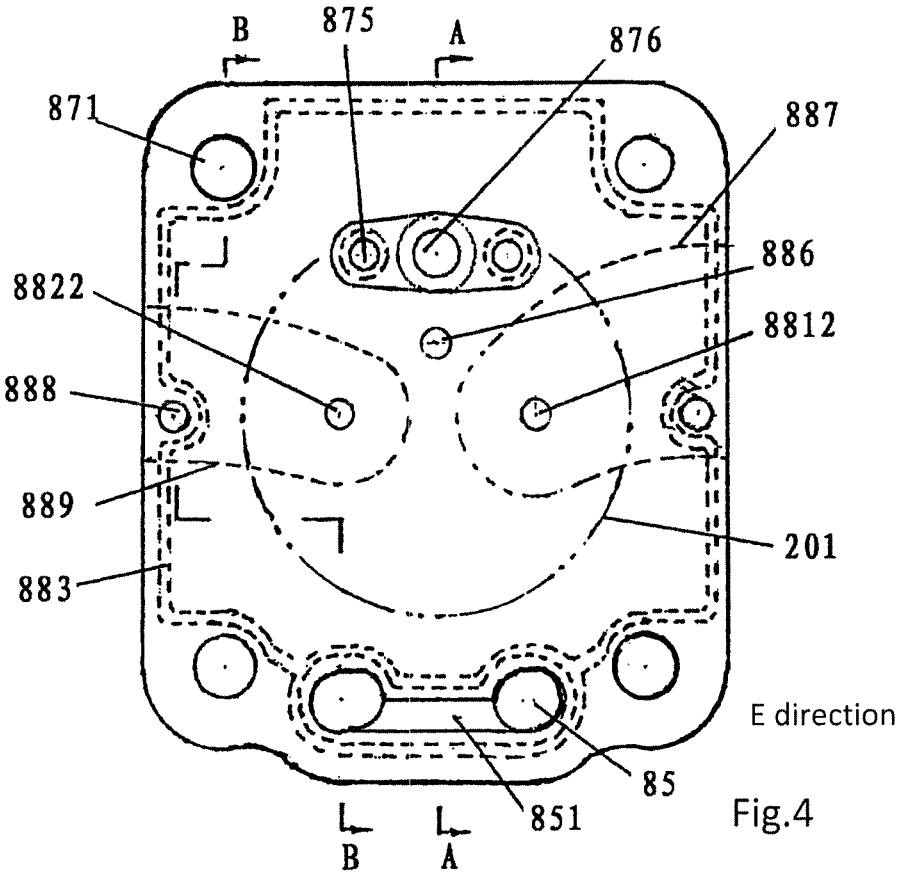
FIG. 4 is an elevation view of the water-cooled single-cylinder internal combustion engine cylinder head according to the present invention, which is viewed in the direction E in FIG. 1.
Figure 6:
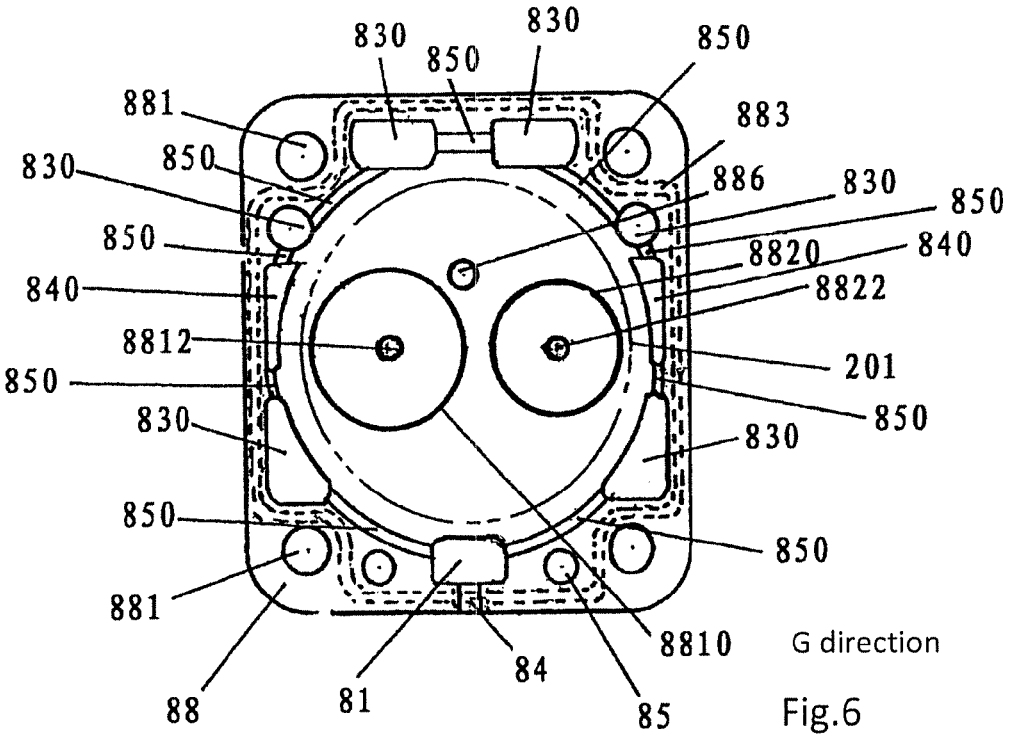
Figure 7:
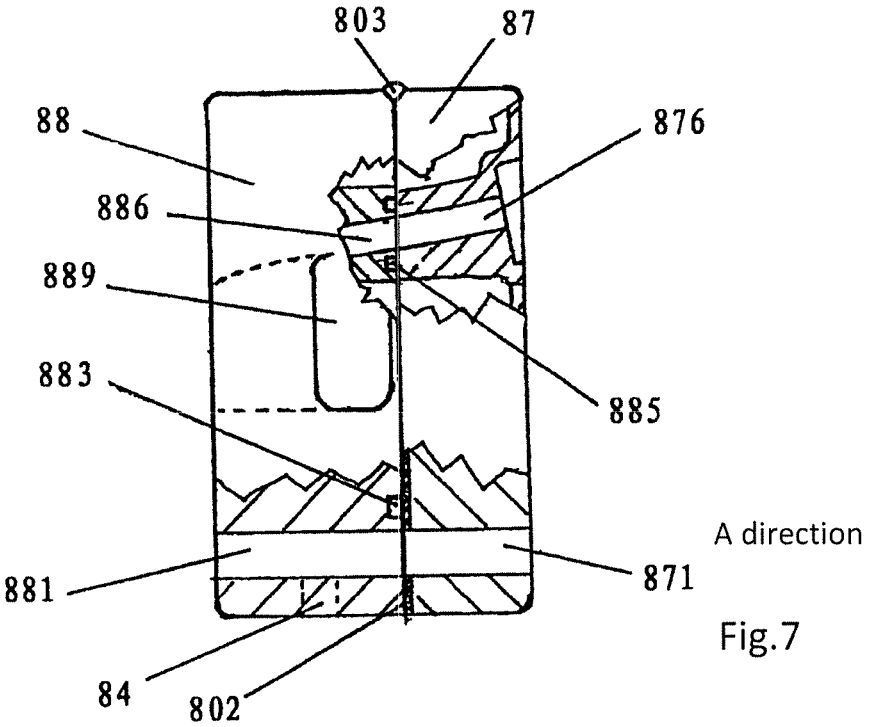
Figure 8:
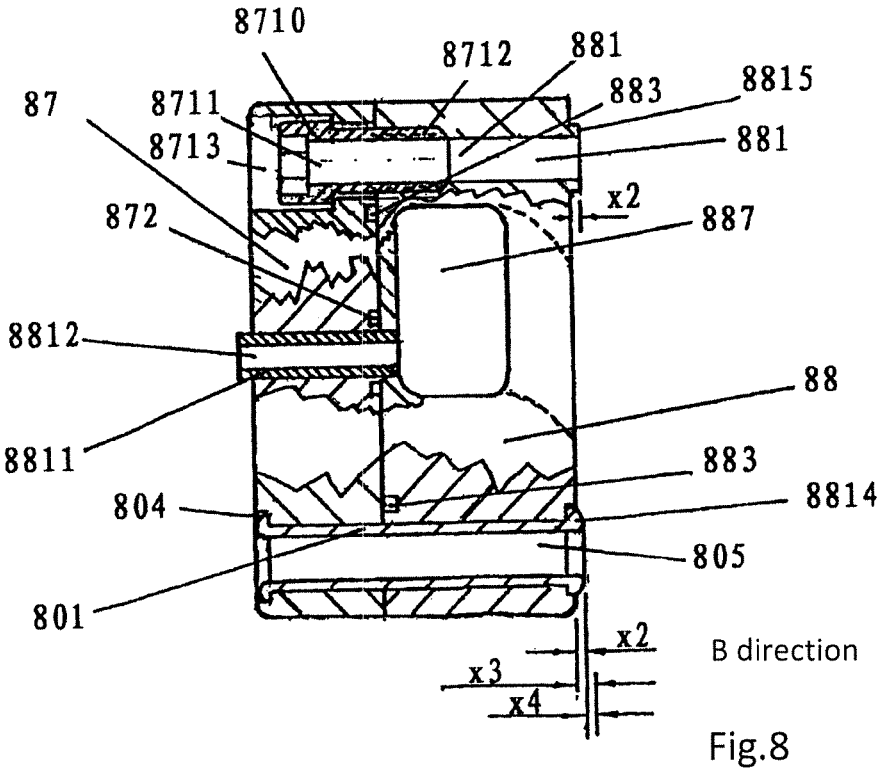
Figure 9:
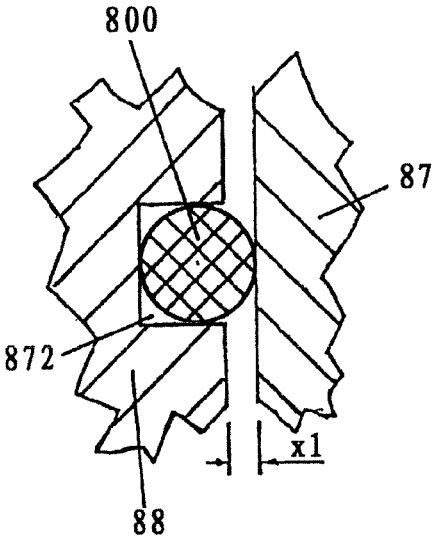
Figure 10:
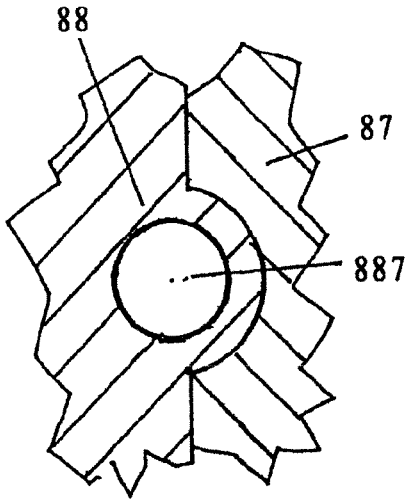
Figure 11:
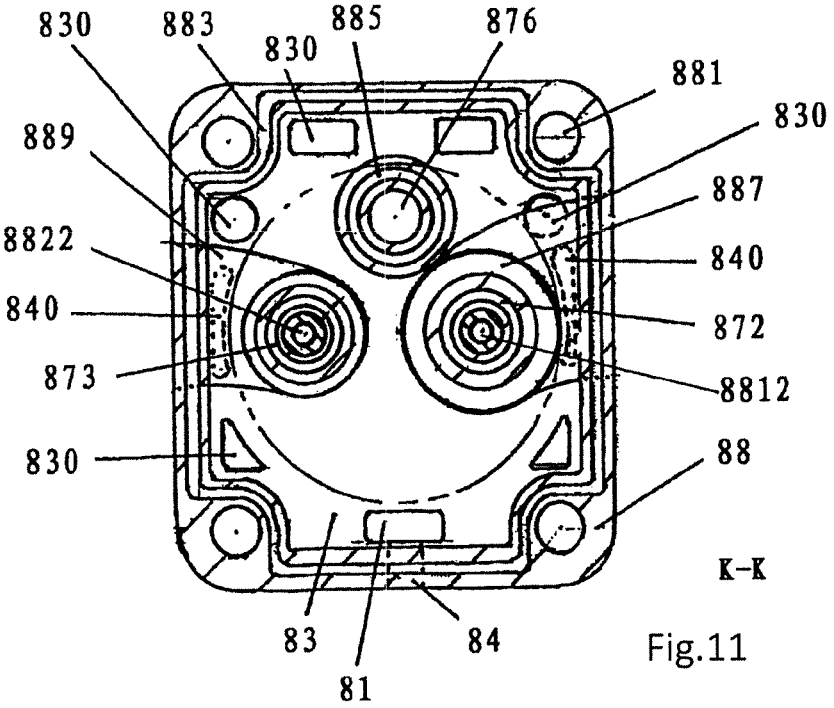
Figure 12:
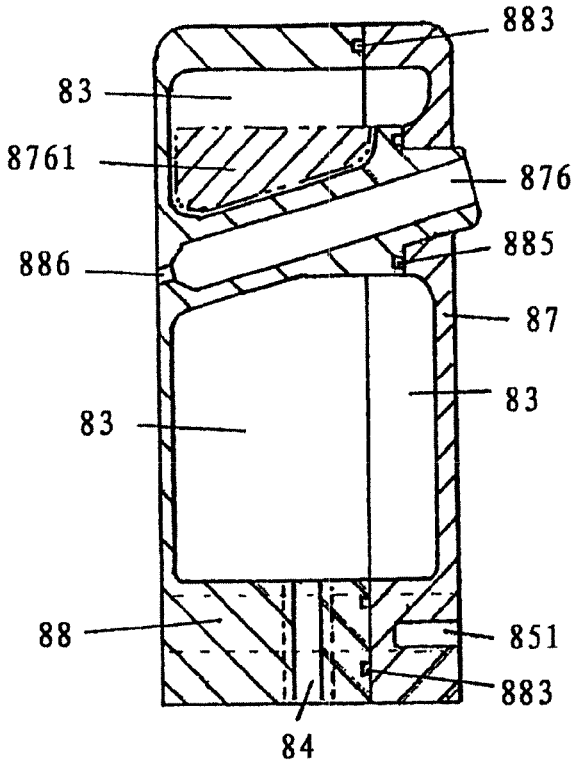
Figure 13:
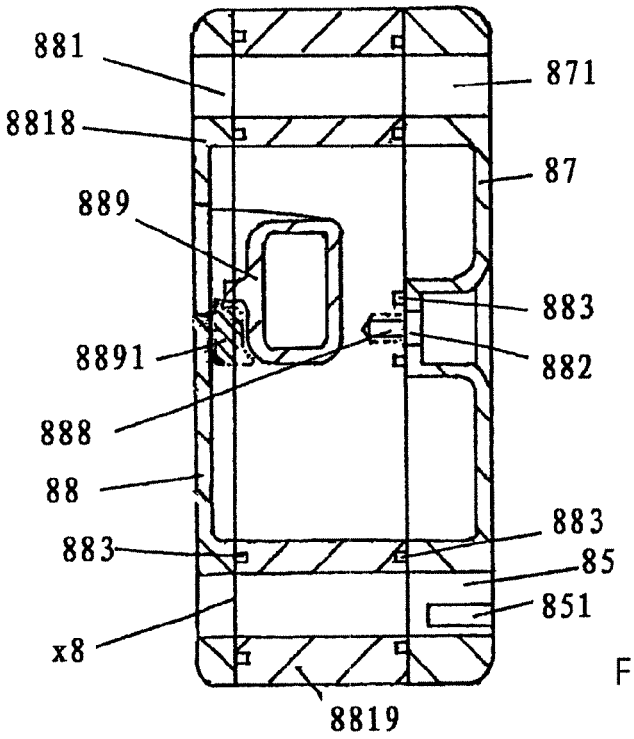
Figure 14:
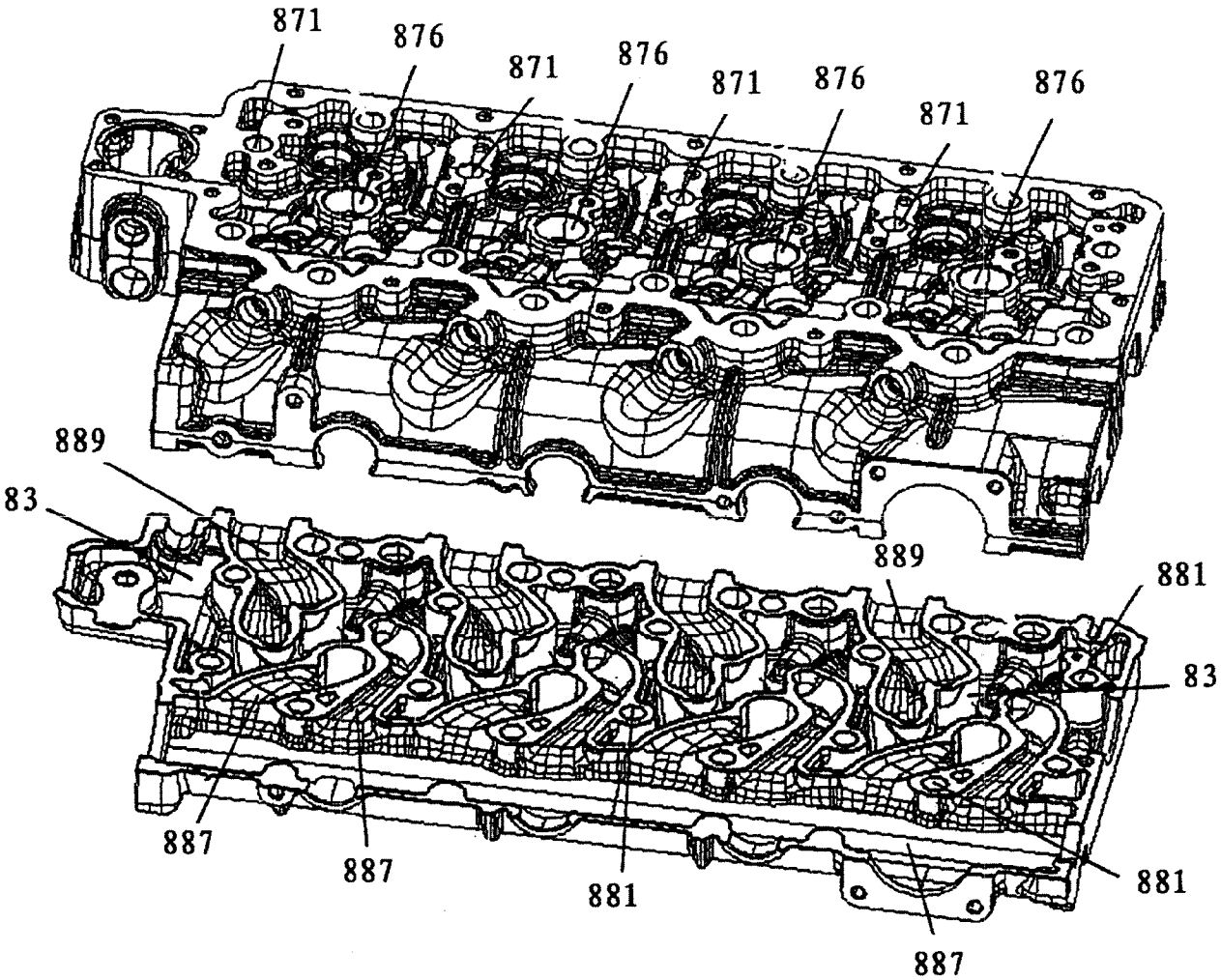
Figure 15:
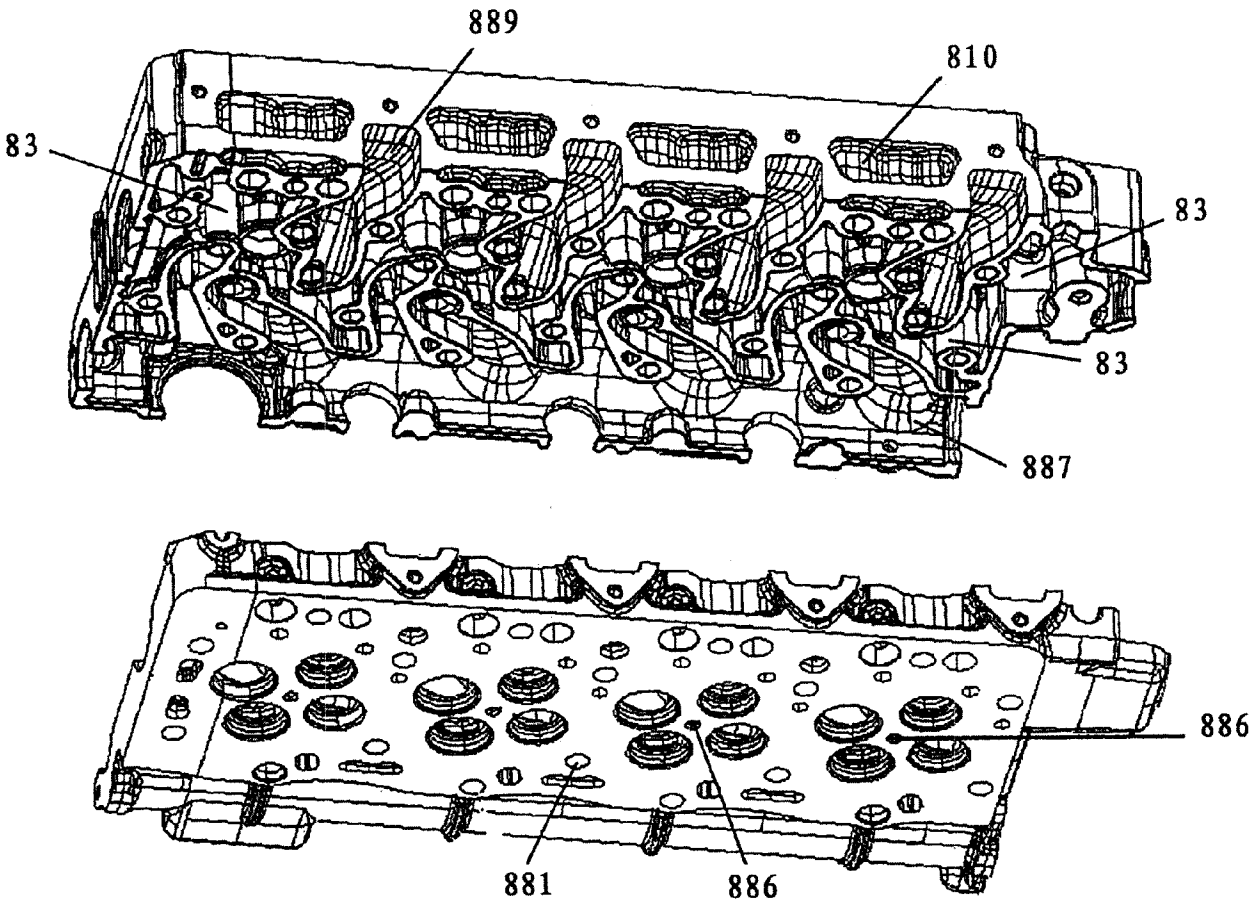
Figure 16:
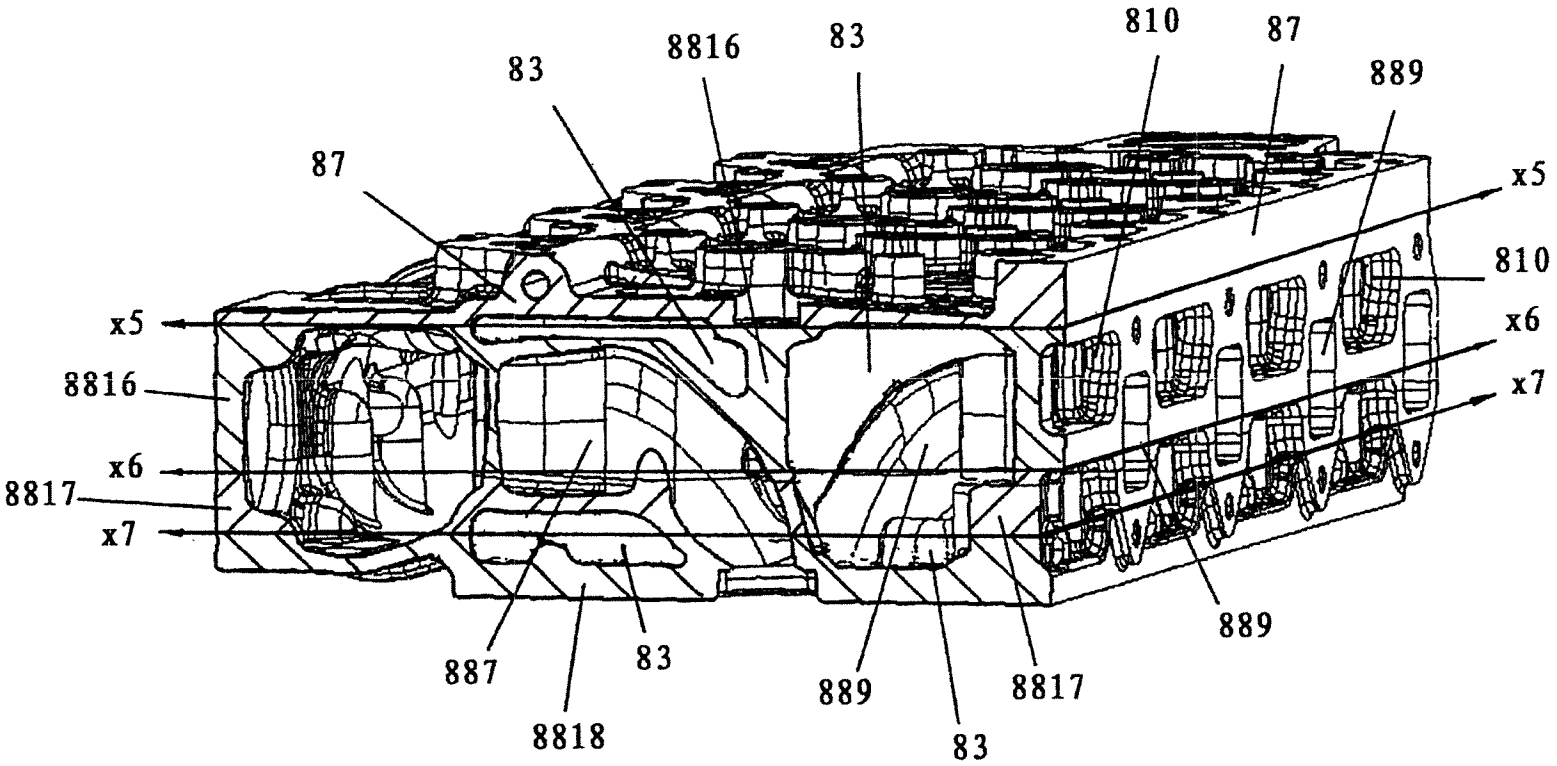
Figure 17:
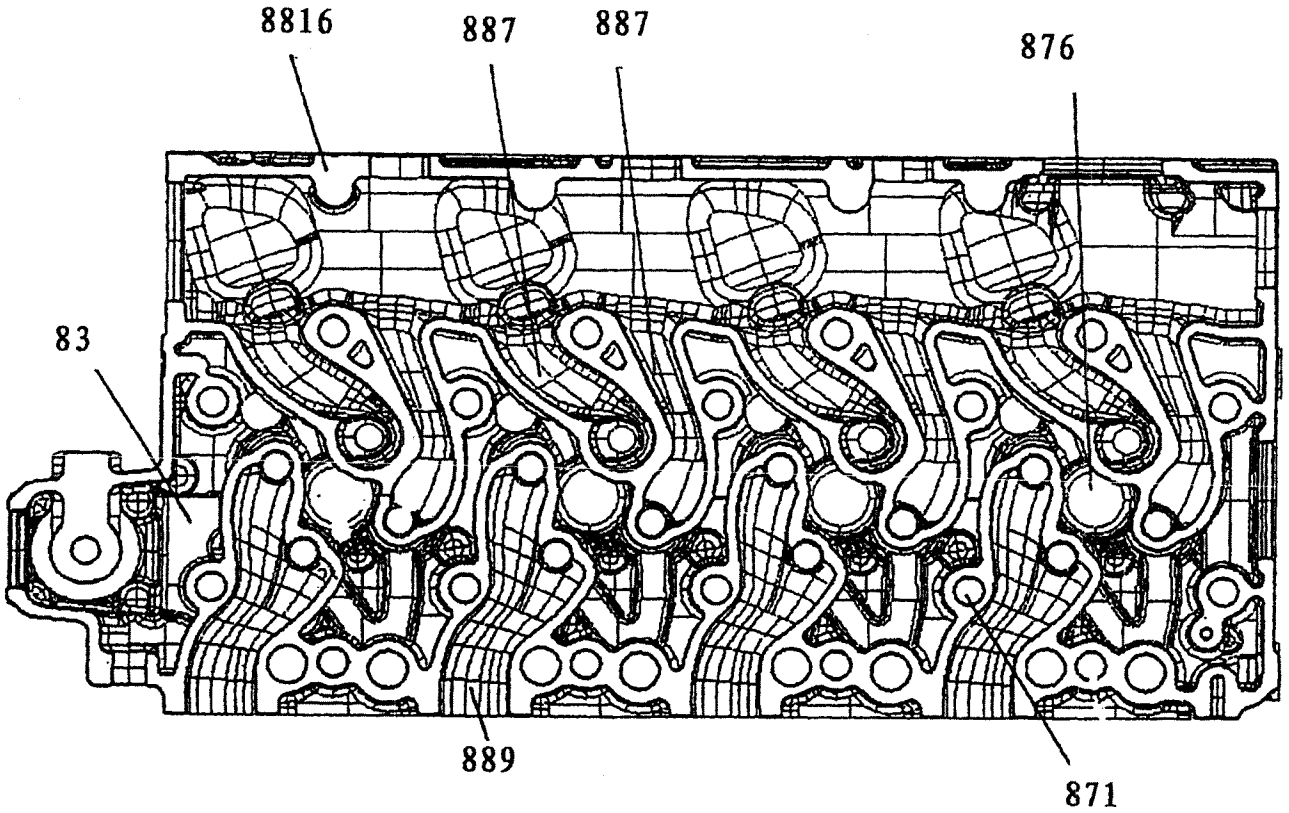
Figure 18:
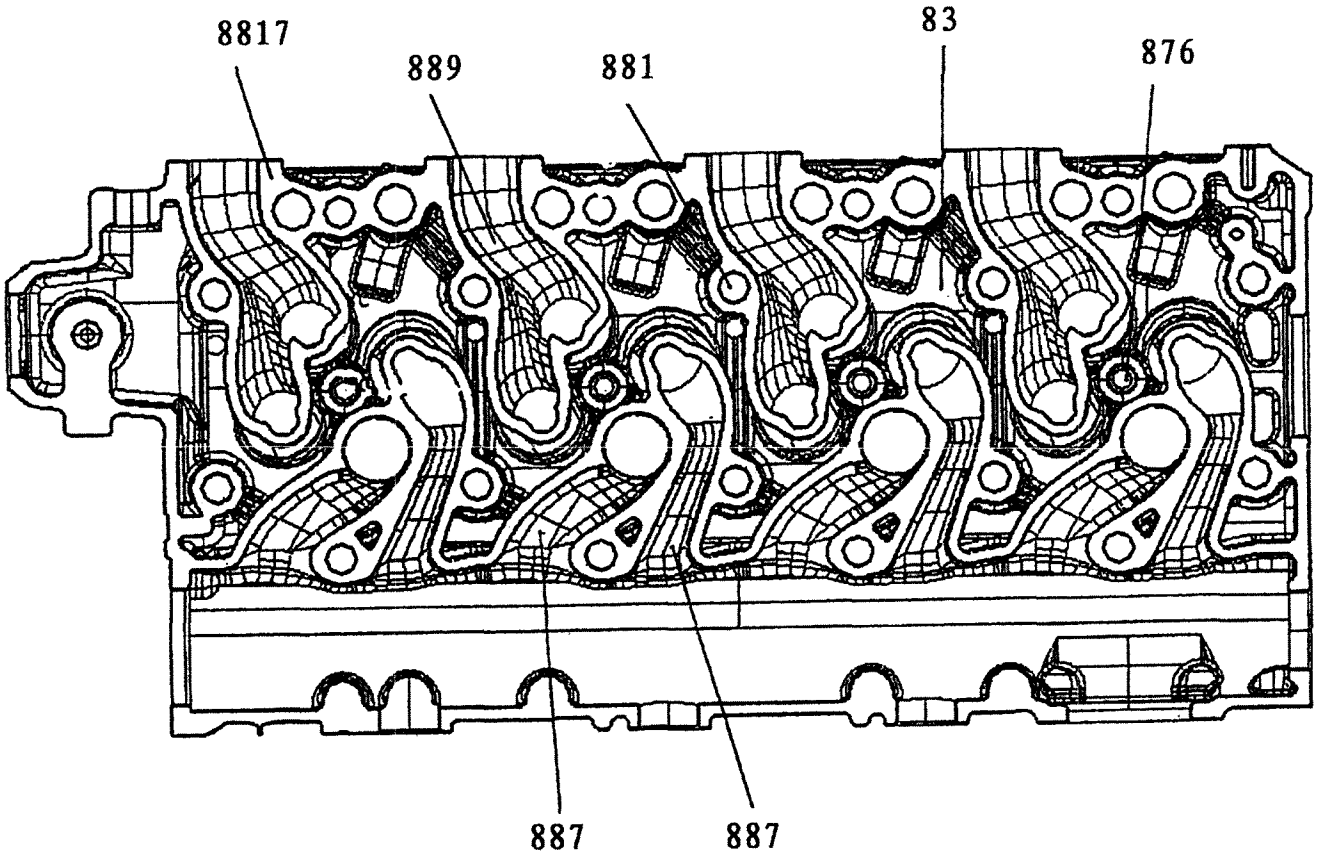
Figure 19:
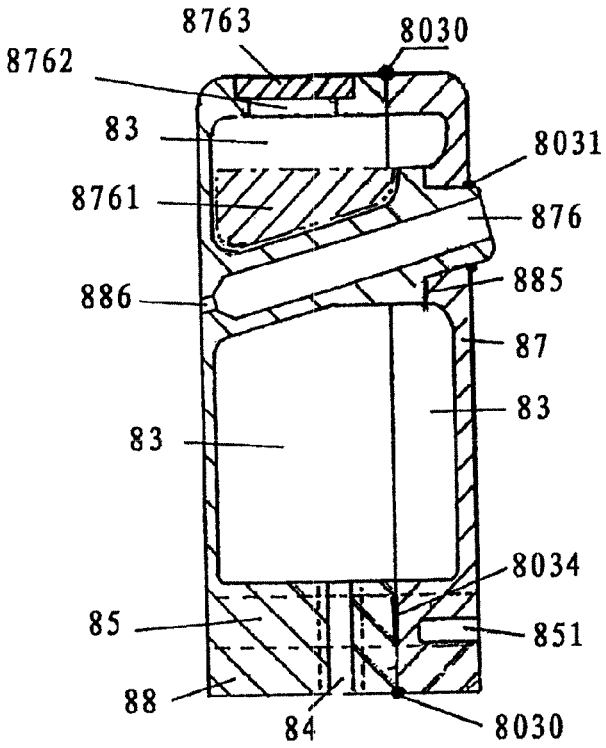
Figure 20:
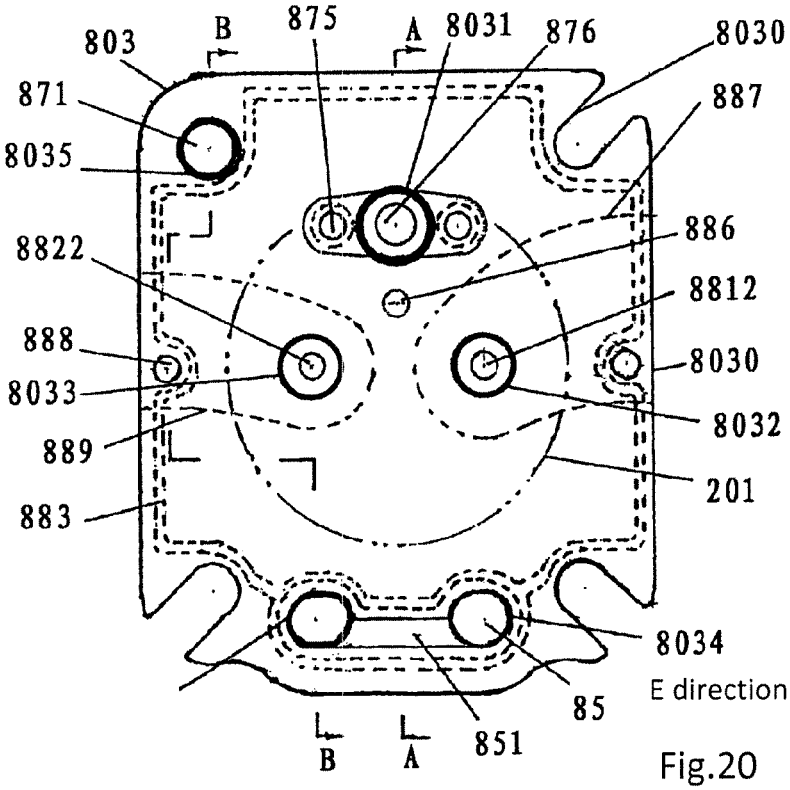
Figure 21:
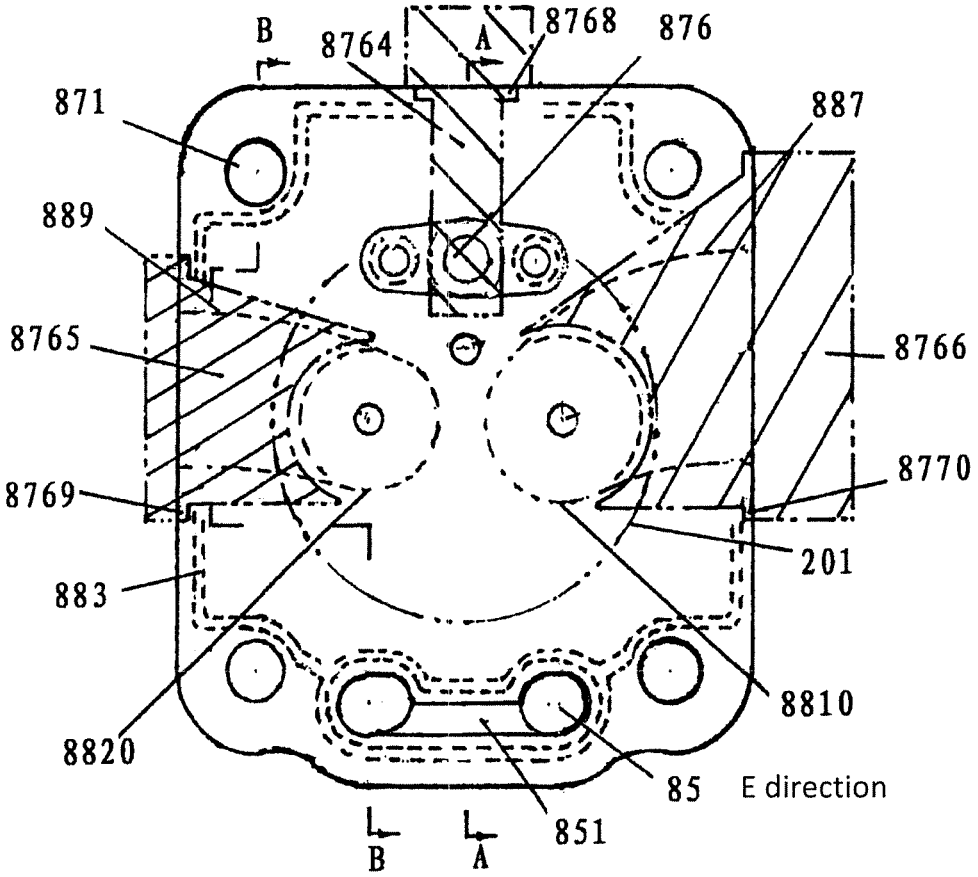
Figure 22:
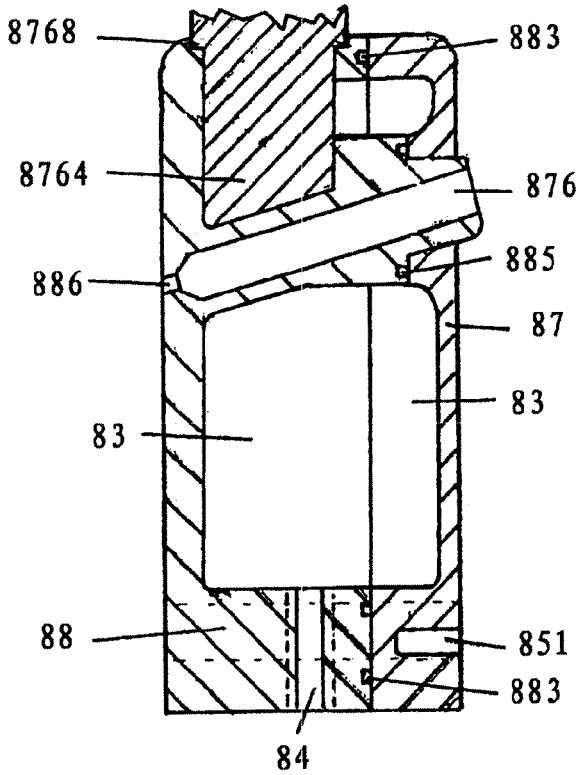
Figure 23:
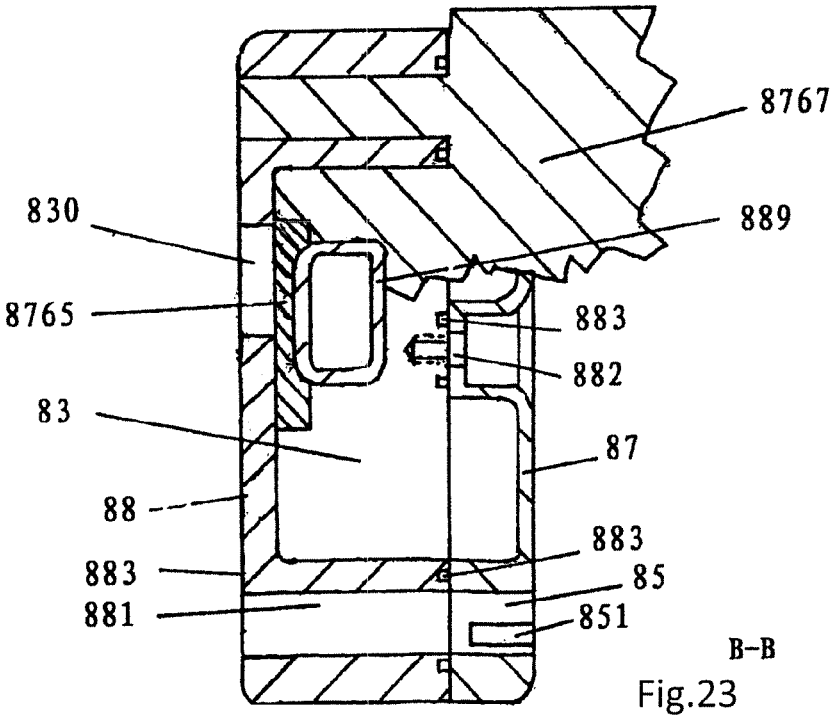
Figure 24:
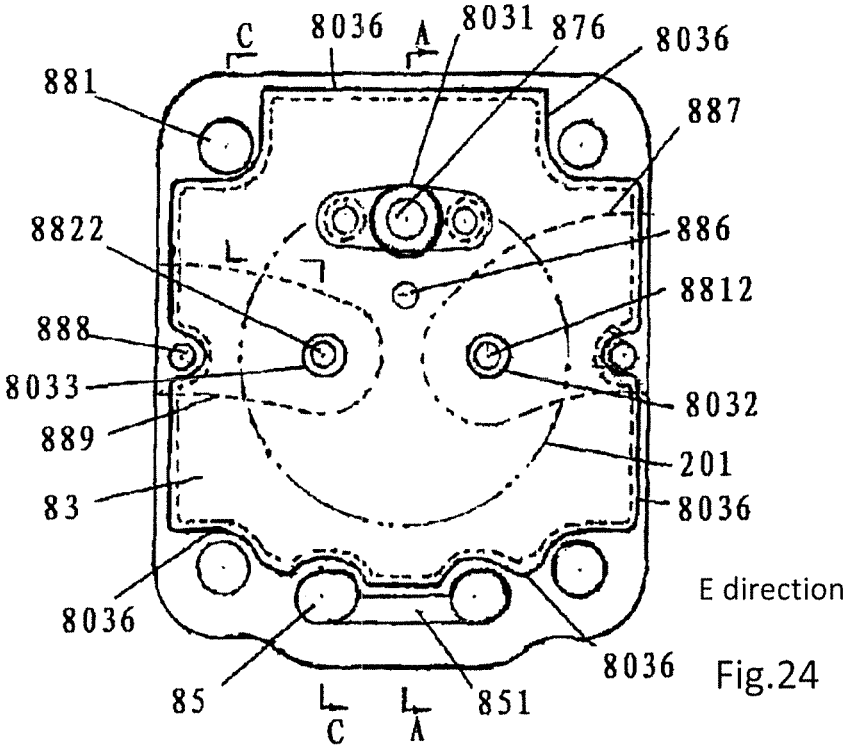
Figure 25:
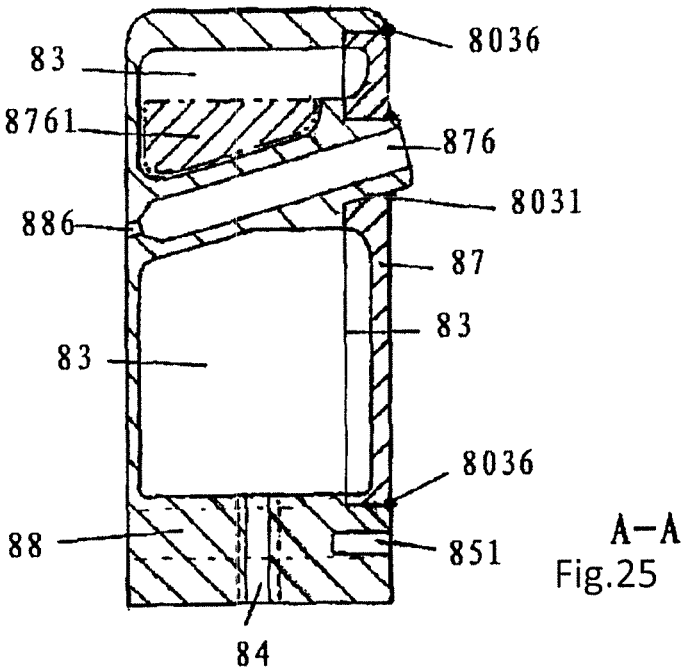
Figure 26:
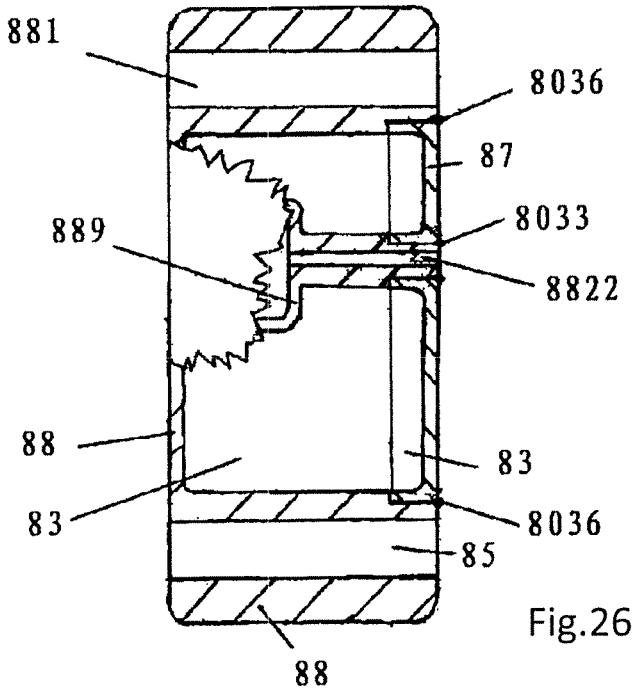
Figure 27:
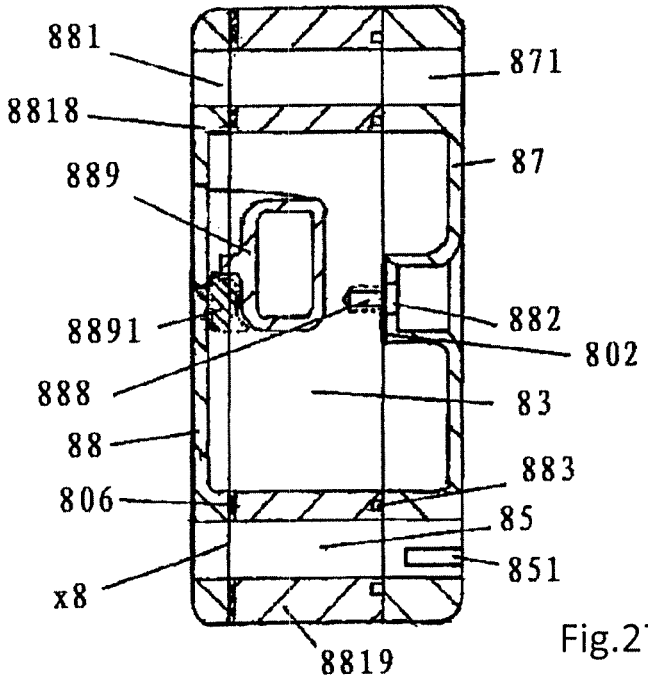
Figure 28:
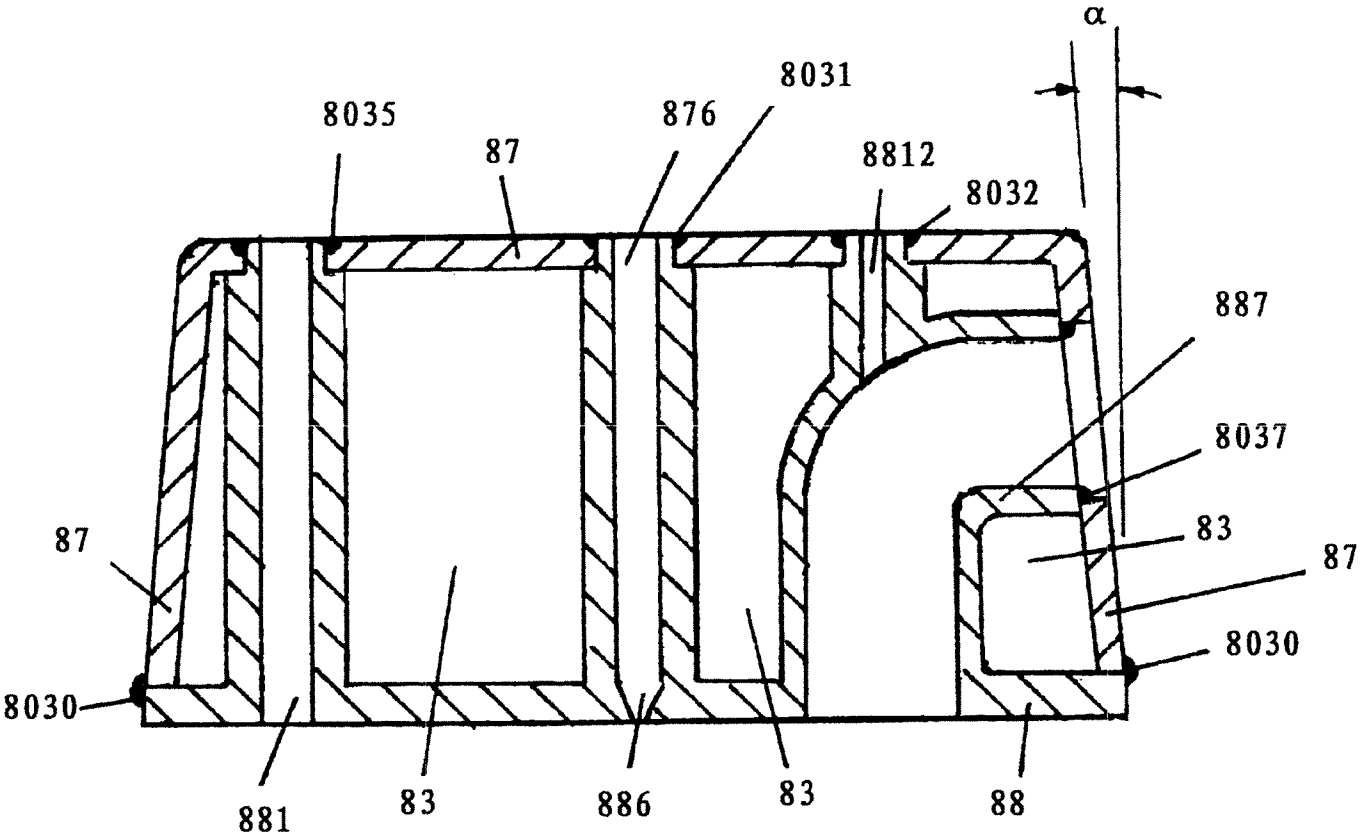

FIG. 6 is an elevation view of the water-cooled single-cylinder internal combustion engine cylinder head according to the present invention, which is viewed in the direction G in FIG. 1, wherein on the bottom plane of the lower cylinder head part 88 of the cylinder head are provided a channel 850 which makes water holes 830 and blind water holes 840 communicate to each other;

FIG. 7 is an elevation view of an embodiment of a cylinder head which is integrated or formed by its upper and lower cylinder head parts, and the two parts are integrated by welding and/or adhering process;

FIG. 8 is an elevation view of an embodiment of a cylinder head which is integrated or formed by its upper and lower cylinder head parts, and the two parts are integrated by bolts or rivets;

FIG. 9 is a sectional view showing an O-ring seal that is fitted in an O-ring sealing groove;

FIG. 10 is a sectional view showing an embodiment in which the parting surface between the upper and lower cylinder head parts includes a curved portion;

FIG. 11 is an elevation view showing a parting surface in the cylinder head of an embodiment, which is viewed in the direction K in FIG. 2;

FIG. 12 is a sectional view of the cylinder head of the embodiment as shown in FIG. 4, taken along line A-A in FIG. 4;

FIG. 13 is a sectional view of the cylinder head of the embodiment as shown in FIG. 4, taken along the stepped line B-B in FIG. 4;

FIG. 14 is a side-top perspective view of a cylinder head of a water-cooled 4-cylinder internal combustion engine;

FIG. 15 is a side-bottom perspective view of the cylinder head of the water-cooled 4-cylinder internal combustion engine as shown in FIG. 14;

FIG. 16 a right-side perspective view of the cylinder head of the water-cooled 4-cylinder internal combustion engine as shown in FIG. 14, showing that the cylinder head is divided into its upper cylinder head part and its lower cylinder head part, and further, the lower cylinder head part is divided into its upper cylinder head sub-part and its lower cylinder head sub-part;

FIG. 17 is a sectional bottom view of both intake duct and exhaust duct of the cylinder head of the water-cooled 4-cylinder internal combustion engine as shown in FIG. 14;

FIG. 18 is a sectional top view of both intake duct and exhaust duct of the cylinder head of the water-cooled 4-cylinder internal combustion engine as shown in FIG. 14;

FIG. 19 is a sectional view of the cylinder head of another embodiment as shown in FIG. 4, taken along line A-A in FIG. 4;

FIG. 20 is an elevation view of the cylinder head as shown in FIG. 1, which is viewed in the direction E in FIG. 1;

FIG. 21 is an elevation view of a cylinder head according to an embodiment of the present invention, showing that it is practicable to insert removable mould cores of a cylinder head mould in several directions, so as to directly form a cooling water cavity in the die-casting blind areas under the fuel injector receiving hole, under the exhaust duct and under the intake duct;

FIG. 22 is a sectional view of the cylinder head as shown in FIG. 21, taken along line A-A in FIG. 21;

FIG. 23 is a sectional view of the cylinder head as shown in FIG. 21, taken along line B-B in FIG. 21;

FIG. 24 is a top view of a cylinder head according to an embodiment in which its upper cylinder head part and its lower cylinder head part are welded together by an endless weld around the periphery of the parting surface between the two parts;

FIG. 25 is a sectional view of the cylinder head as shown in FIG. 24, taken along line A-A in FIG. 24;

FIG. 26 is a sectional view of the cylinder head as shown in FIG. 24, taken along line C-C in FIG. 24;

FIG. 27 is a sectional view of a cylinder head, showing that an O-ring sealing groove, an adhesive sealant, and a non-adhesive sealant are employed in combination at the parting surface in the cylinder head; and FIG. 28 is sectional view of a cylinder head according to another embodiment in which its upper cylinder head part and its lower cylinder head part are welded together by welds.

DESIGNATION OF REFERENCE NUMBERS

10—fuel injector, 20—piston, 29—air cleaner, 30—muffler, 40—cylinder liner, 50—water tank, 60—fuel tank, 70—cylinder block, 72—water cavity of cylinder block, 73—water communication hole between cylinder block and cylinder head, 74—cylinder head bolt, 75—fuel injector, 76—cylinder head housing, 80—cylinder head, 81—water communication hole between cylinder head and cylinder block, 83—water cavity of cylinder head, 84—water drain hole of cylinder head, 85—cam follower receiving hole, 86—cam follower, 87—upper cylinder head part, 88—lower cylinder head part, 90—cylinder block housing, 201—piston contour line, 800—O-ring, 801—tubular rivet, 802—adhesive sealant, 803—weld, 8030—endless weld around the periphery of parting surface between upper cylinder head part and lower cylinder head part, 8031—weld of the fuel injector receiving hole portion, 8032—weld of the intake valve stem receiving hole portion, 8033—weld of the exhaust valve stem receiving hole portion, 8034—weld of the cam follower receiving hole portion, 8035—weld of the cylinder head bolt hole portion, 8036—endless weld along periphery of upper cylinder head part and corresponding to the outer edge of water cavity, 8037—endless welds around the end openings of the intake/exhaust duct through holes in upper cylinder head part and the intake/exhaust duct through holes in lower cylinder head part, 804—recess for riveting, 805—though holes, 806—non-adhesive sealant, 810—cooling water flow ports, 830—water hole, 840—blind water hole, 850—channel, 871—bolt hole of upper cylinder head part, 872—O-ring groove around intake valve stem receiving hole, 873—O-ring groove around exhaust valve stem receiving hole, 875—holes for fastening fuel injector, 876—fuel injector receiving hole, 877—screw hole for fixing valve rocker support, 8710—tubular bolt, 8711—through hole of tubular bolt, 8712—threads of bolt, 8713—counterbore, 8761—process-required insert, 8762—though hole for taking out core, 8763—sealing plug, 8764—removable mould core piece inset in die-casting blind area under fuel injector receiving hole, 8765—removable mould core piece inset in die-casting blind area under exhaust duct, 8766—removable mould core piece inset in die-casting blind area under intake duct, 8767—projecting molding piece of lower cylinder head part, 8768—step hole for insetting sealing plug at fuel injector receiving hole, 8769—step hole for insetting sealing plug at exhaust duct, 8770—step hole for insetting sealing plug at intake duct, 881—screw hole in lower cylinder head part, 882—though hole for connecting screw, 883—O-ring groove for sealing water cavity, 885—O-ring groove for sealing fuel injector receiving hole, 886—end opening of fuel injector receiving hole, 887—intake duct, 888—screw hole, 889—exhaust duct, 8809—through hole for connecting screw, 8810—intake valve lines, 8811—guide sleeve of intake valve stem, 8812—intake valve stem receiving hole, 8813—intake valve stem, 8814—boss for riveting, 8815—boss, 8816—upper sub-part of lower cylinder head part, 8817—middle sub-part of lower cylinder head part, 8818—lower sub-part of lower cylinder head part, 8819—upper sub-part of lower cylinder head part, 8820—exhaust valve lines, 8821—guide sleeve of exhaust valve stem, 8822—exhaust valve stem receiving hole, 8823—exhaust valve stem, 8891—process-required inserts, x1—compression deformation of O-ring, x2—height of boss, x3—thickness of cylinder head gasket, x4—compression deformation of cylinder head gasket when being assembled and fastened, x5—parting surface of cylinder head, x6—the first parting surface of lower cylinder head part, x7—the second parting surface of lower cylinder head part, x8—parting surface of lower cylinder head part, α—draft (demoulding) angle.

DETAILED DESCRIPTION OF EMBODIMENTS OF THE PRESENT INVENTION

The present invention is now described in detail with reference to the accompanying drawings.

FIG. 1 shows a sectional view of a water-cooled single-cylinder internal combustion engine. As shown in FIG. 1, the internal combustion engine comprises a cylinder block 70 and a cylinder head 80 mounted on the block 70. A water hole 830, shown by a broken line, in the cylinder head 80 is aligned with and communicated with the water hole 73 in the cylinder block 70. A water cavity 83 in the cylinder head 80 has a complicated shape and is surrounded by solid portion, so in the past it could only be formed by sand-mould casting with cores.

Figure 3:
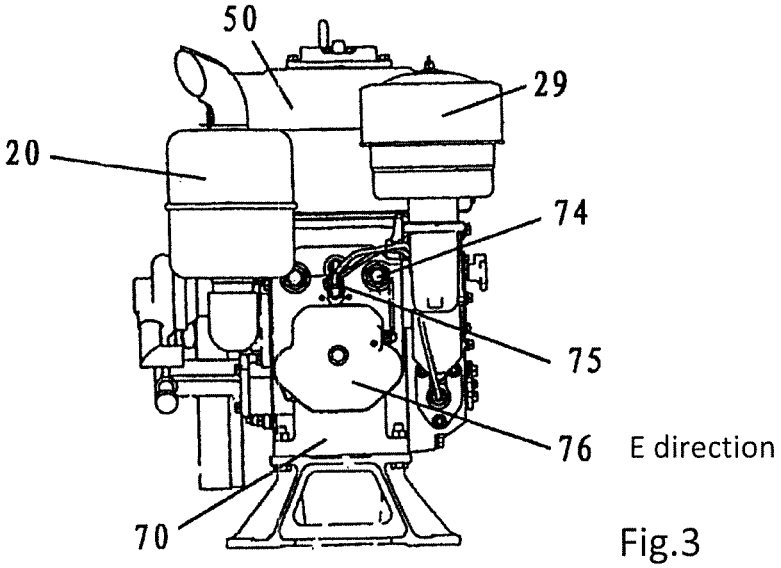
FIG. 3 is an elevation view of the water-cooled single-cylinder internal combustion engine according to the present invention, which is viewed in the direction E in FIG. 1.

FIG. 2 shows a sectional view of a water-cooled single-cylinder internal combustion engine, which is viewed in the direction F in FIG. 1. As shown in FIG. 2, in the cylinder head 80, there are a water cavity 83, an intake duct 887 and an exhaust duct 889. FIG. 3 is an elevation view of a water-cooled single-cylinder internal combustion engine of the present invention, which is viewed in the direction E in FIG. 1. As can be seen in FIG. 3, in the single-cylinder internal combustion engine, the cylinder head 80 is assembled and fastened to the cylinder block 70 with cylinder head bolts 74.

As can be clearly seen in FIG. 2, the water cavity 83 in the cylinder head 80 surrounds the intake duct 887 and the exhaust duct 889, and has a complicated shape. According to conventional viewpoints in this technical field, because there has been no way to realize demoulding in die-casting process, the water cavity of this kind could not be formed by die-casting process, but could only be formed by using core(s) in sand-mould casting for a cylinder head. However, upon study by the inventor of the present invention, this is a conventional prejudice. According to the present invention, as shown in FIG. 2, by allowing the cylinder head to be divided into two parts, i.e. its upper cylinder head part and its lower cylinder head part and by properly selecting a parting surface between the two parts, for example, by dividing the cylinder head into the two parts along the line K-K, and by manufacturing the two parts separately with one portion of the water cavity in the upper cylinder head part and with the other portion of the water cavity in the lower cylinder head part, it is easy to realize demoulding and taking mould core out so as to form a complicated-shaped cylinder head water cavity. In this way, the upper cylinder head part and the lower cylinder head part can be formed separately by die-casting process, so that the intake duct, exhaust duct and fuel injector receiving hole can be formed by die-casting process at the same time.

Figure 5:
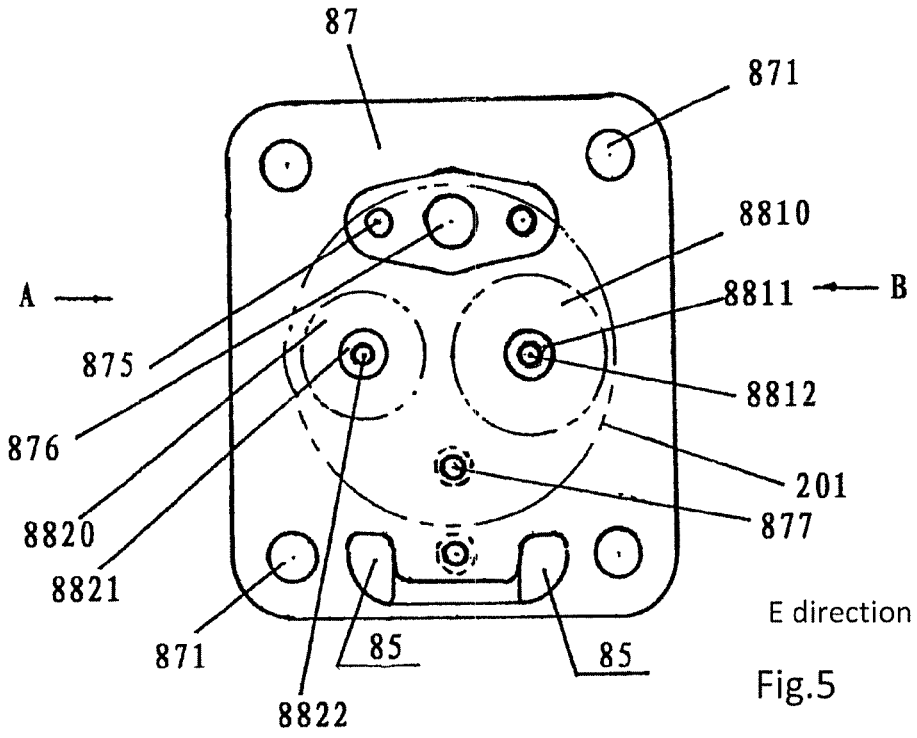
FIG. 5 is an elevation view of the water-cooled single-cylinder internal combustion engine cylinder head according to the present invention, which is viewed in the direction E in FIG. 1.

FIGS. 4 and 5 are elevation views of the upper cylinder head part 87, which are both viewed in the direction E in FIG. 1. FIG. 6 is an elevation view of the lower cylinder head part 88, which is viewed in the direction G in FIG. 1. The upper cylinder head part 87 and the lower cylinder head part 88 can be integrated as the whole cylinder head 80 by welding, adhering, bolting and/or riveting.

As shown in FIG. 4, the upper cylinder head part 87 is provided with screw holes 888 for fastening the upper cylinder head part 87 to the lower cylinder head part 88. As shown in FIG. 5, the upper cylinder head part 87 is provided with a screw hole 877 for fixing a valve rocker support.

As shown in FIG. 6, the lower cylinder head part 88 is provided with an O-ring groove 883 around the cylinder head water cavity 83, and the lower cylinder head part 88 is also provided with though water holes 830, blind water holes 840 and a though water hole 81, these holes communicate the water cavity 72 in the cylinder block with the cylinder head water cavity 83. There is provided a channel 850 which makes the water holes 830, blind water holes 840 and though water hole 81 in communication with each other. The channel 850 is very easy to be formed by die-casting process and can be positioned precisely, the blind water holes 840 can be communicated with the though water holes 830 through the channel 850.

FIG. 7 shows an embodiment in which the upper cylinder head part 87 and the lower cylinder head part 88 are integrated or combined to form a cylinder head by welding and/or adhering. In FIG. 7, reference number 803 denotes a weld and reference number 802 denotes an adhesive sealant. For sake of simplicity, the weld 803 and the adhesive sealant 802 are both shown in FIG. 7, however, it should be understood that the upper cylinder head part 87 and the lower cylinder head part 88 can be integrated or combined by welding or adhering or by both. In FIG. 7, there are shown an O-ring groove 885 and an O-ring groove 883 at the parting surface, the former is around a fuel injector receiving hole 876 and the latter is around the water cavity. An O-ring is fitted in the groove 885 and groove 883 respectively so as to seal the fuel injector receiving hole 876 and the water cavity before integrating the upper cylinder head part 87 and the lower cylinder head part 88. In the embodiment in which the upper cylinder head part 87 and the lower cylinder head part 88 are integrated with an adhesive sealant, still using O-rings will attain even better sealing effect. Nevertheless, because the adhesive sealant can attain the same better sealing effect, O-ring sealing means can be omitted. In addition, as can be seen in FIG. 7, the cylinder head bolt holes used for fixing the cylinder head 80 on a cylinder block 70 are divided into bolt holes 871 in the upper cylinder head part 87 and bolt holes 881 in the lower cylinder head part 88. Similarly, the fuel injector receiving hole 876 is divided into one portion in the upper cylinder head part 87 and another portion in the lower cylinder head part 88.

FIG. 8 shows another embodiment in which the upper cylinder head part 87 and the lower cylinder head part 88 are integrated or combined to a cylinder head 80 by bolts and/or rivets. As shown in FIG. 8, the bolt hole 871 in the upper cylinder head part 87 and the bolt hole 881 in the lower cylinder head part 88 are modified in order to allow specialized tubular bolts 8710 to be screwed into the holes so as to joint the upper cylinder head part 87 and the lower cylinder head part 88 into the whole cylinder head 80. Cylinder head bolts can be inserted through the through holes 8711 formed in the tubular bolts 8710 so as finally to fix the whole cylinder head 80 on the cylinder block 70. Furthermore, O-rings 800 are fitted in their corresponding grooves 872, 873 and 883 respectively so as to seal the intake valve stem receiving hole, the exhaust valve stem receiving hole and the water cavity. On the other hand, it is also feasible to employ tubular metal rivets 801 to join the upper cylinder head part 87 and the lower cylinder head part 88 into the whole cylinder head 80. The wall thickness of the tubular metal rivets 801 can be properly designed to be a little thinner for saving space. In FIG. 8, the tubular metal rivets 801 are provided each with a boss 8814, but this is not required, the two opposite ends of the tubular metal rivets 801 can be made be flush with the top surface of the upper cylinder head part 87 and the bottom surface of the lower cylinder head part 88. For a multi-cylinder engine, if tubular metal rivets are used to integrate the upper cylinder head part 87 and the lower cylinder head part 88, it is practicable to work on plurality of rivets simultaneously so as to improve production efficiency and reduce production cost. For the existing originally designed cylinder heads, coordinate positions of the cylinder head bolt holes are not certainly necessary to be changed, instead, by insetting tubular metal rivets in the originally designed cylinder head bolt holes in the upper cylinder head part and lower cylinder head part, the two separately manufactured cylinder head parts can be finally integrated to the whole cylinder head. Likewise, for sake of convenience, in FIG. 8, two integrating means, that is, bolting and riveting joints are both shown on the same one cylinder head, however, it should be understood that the bolting joint or riveting joint can be used separately or together to integrate the upper cylinder head part 87 and the lower cylinder head part 88 as a whole.

Therefore, for integrating cylinder head parts, among welding, adhering, bolting and riveting, any one can be selected to be used separately, or two or more can be used in combination. For sealing, it is practicable to employ either O-rings or adhesive sealants or both.

FIG. 11 is an elevation view of the cylinder head as shown in FIG. 2, which is viewed in the direction K in FIG. 2. In FIG. 11, blind water holes 840 are hidden by the intake duct 887 and exhaust duct 889, and hence being represented by broken lines. At the right upper corner of FIG. 11, upper half portion of a water hole 830 is not hidden by the intake duct 887 and hence being communicated directly to the cylinder head water cavity 83, here, the water hole 830 is called partially-blind and partially-through hole. In addition, an intake valve stem receiving hole 8812 and an exhaust valve stem receiving hole 8822 are also shown in FIG. 11. O-ring grooves 872 and 873 for sealing the intake valve stem and exhaust valve stem receiving holes are each provided around the intake valve stem receiving hole 8812 and exhaust valve stem receiving hole 8822 respectively.

As an example, FIG. 9 shows that a O-ring 800 is fitted in place in a groove 872 mated thereto around the intake valve stem receiving hole. In its fitted position, O-ring 800 is forced to have an elastic deformation to ensure sealing. Though not shown in this FIG., it should be understood that the groove 873 around the exhaust valve stem receiving hole is also fitted with an O-ring.

The parting surface between the upper cylinder head part 87 and the lower cylinder head part 88 is a straight (planar) plane, because it is easy to integrate them and to form a seal therebetween. In addition, the upper cylinder head part 87 and the lower cylinder head part 88 can have a non-planar but complementary parting surface, such as curved, stepped or zigzagged surfaces, so long as they can realize integrating and sealing. As shown in FIG. 10, for example, the lower cylinder head part 88 has a convex curved surface around the intake duct 887, the upper cylinder head part 87 has a corresponding concave curved surface, and the intake duct 887 is shifted upward beyond the planar parting surface between the upper cylinder head part 87 and the lower cylinder head part 88. In addition, the exhaust duct 889 can be similarly shifted upward beyond the planar parting surface between the upper cylinder head part 87 and the lower cylinder head part 88, but which is not shown in this figure.

Further, FIG. 12 shows an embodiment in which the fuel injector receiving hole 876 is formed together with the lower cylinder head part 88. In FIG. 12, the fuel injector receiving hole 876 is formed at its front end an end opening 886 for fuel being injected therethough. In the embodiment shown in FIG. 12, the fuel injector receiving hole 876 is formed together with the lower cylinder head part 88. As shown in FIG. 7, by putting a process insert (an insert piece necessary for casting process)8761 in the position in the mould where it is difficult to make demoulding before die-casting, and by removing the process insert after completing the casting, the fuel injector receiving hole 876 is formed integrally with the lower cylinder head part 88.

As shown in FIG. 13, at the time to cast the whole lower cylinder head part 88 and before the die casting, a process insert 8891 is put into the mould, whose shape corresponds to the water cavity 83 between the intake and exhaust ducts and the bottom of the lower cylinder head part 88, and the process insert 8891 is removed after the die casting. Because it is necessary to prepare the process insert 8891 and to spend man-hours for putting the same into the mould before casting and for removing the same after casting, this is disadvantageous to reduce production cost and to improve production efficiency. Taking this into account, preferably, it will be further advantageous to make the cylinder head's lower cylinder head part 88 be composed of, or in other words, divided into its upper cylinder head sub-part and its lower cylinder head sub-part. The parting surface x8 between the upper and lower sub-parts of the lower cylinder head part 88 is just positioned in the water cavity 83 in the lower cylinder head part 88, and at the parting surface between the upper and lower sub-parts of the lower cylinder head part 88 is also provided O-rings 800 and/or adhesive sealants, thereby the process insert 8891 is no longer necessary. After the upper cylinder head part 87 and the upper and lower sub-parts of the lower cylinder head part 88 are manufactured separately by die-casting process, the three parts can be integrated by welding, adhering, bolting and riveting so as to form the whole cylinder head.

The present invention can not only be used for water-cooled single-cylinder internal combustion engine, but also for water-cooled multi-cylinder internal combustion engine.

For example, FIG. 14 shows a cylinder head of a water-cooled 4-cylinder internal combustion engine, each combustion chamber is provided with two intake valves and two exhaust valves, and both the intake duct and exhaust duct have a curved helical shape, and a main intake duct is communicated with eight intake ducts. In the conventional casting process, because of a complicated shape, it is impossible to directly draw the mould core out from lateral sides when forming the cavities of the intake and exhaust ducts by die-casting process.

FIG. 15 is a side bottom perspective view of the cylinder head of the water-cooled 4-cylinder internal combustion engine as shown in FIG. 14, a cooling water flow port 810 is located obliquely above the exhaust duct 889.

FIG. 16 a right side perspective view of the cylinder head of the water-cooled 4-cylinder internal combustion engine as shown in FIG. 14, showing an embodiment in which the lower cylinder head part 88 can be further separately formed. The outer walls of both whole intake duct 887 and whole exhaust duct 889 as well as the cylinder head water cavity 83 are all located under the parting surface x5 of the cylinder head. The first parting surface x6 in the lower cylinder head part 88 is cut through the intake duct and exhaust duct. The curved helical intake duct and exhaust duct can be formed by die-casting process without taking-out-core process. The second parting surface x7 in the lower cylinder head part 88 is cut through the cylinder head water cavity 83 between the intake and exhaust ducts 887, 889 and the bottom of the lower cylinder head part 88, and hence there is no need to use the process insert 8891 and complicated cores. The upper sub-part 8816, the middle sub-part 8817 and the lower sub-part 8818 of the lower cylinder head part 88 can be integrated to form the lower cylinder head part 88 by welding, adhering, bolting and/or riveting. The embodiment as shown in FIG. 16 allows forming complicated curved helical intake and exhaust ducts directly by die-casting process. The design of the multi-part cylinder head of this embodiment allows adding enforcement ribs from holes to holes in the water cavity without changing the original positions of the holes. At the parting surfaces is provided O-rings 800 and/or adhesive sealants 802. By insetting a thin-wall tubular metal rivet in every cylinder head bolt hole, it is easy to rivet the cylinder head parts together to form the whole cylinder head 80. Working on a plurality of tubular rivets so as to make them fastened can be carried out simultaneously. It is easy to understand that the design and manufacture method described in this embodiment can meet design requirements of original cylinder head, reduce production cost and ensure consistency of products.

FIG. 17 is an upward sectional view of both the intake duct and exhaust duct of the cylinder head of the water-cooled 4-cylinder internal combustion engine as shown in FIG. 14. Upon applying adhesive sealant 802 on the parting surface of the corresponding intake and exhaust ducts, the cylinder head parts can be integrated to form the whole cylinder head 80. The existing available adhesive sealants can be easily employed to attain sealing at the parting surface.

FIG. 18 is a sectional top view of both intake duct and exhaust duct of the cylinder head of the water-cooled 4-cylinder internal combustion engine as shown in FIG. 14, and the intake and exhaust ducts are divided into two halves by the parting surface. After fitting O-rings 800 in the grooves at the parting surface and/or applying an adhesive sealant 802 on the parting surface of the cylinder head parts, the cylinder head 80 can be formed by welding, adhering, bolting and/or riveting procedures. The present invention have, for the first time, successfully realized direct formation of the intake and exhaust ducts in the cylinder head of water-cooled internal combustion engine by die-casting process without taking out mould core, with the intake and exhaust ducts having even higher formation precision and even higher die-casting efficiency. The existing available high temperance-resistant, anti-ageing and high-strength adhesive sealants can be used to adhere the parting surfaces of the multi-part cylinder head of the present invention. The surfaces obtained in modern precise die-casting process can be directly applied with these adhesive sealants and attain required performance without needing machining in advance, thereby it is easy to realize automatic mass production of the multi-part cylinder head of the present invention for water-cooled single- and multi-cylinder internal combustion engines Furthermore, for the cylinder heads as shown in FIGS. 7, 13, 14, 15, 16, 17, 18 and 27, joints of all the connecting surfaces at the parting surface x5 between the upper and lower cylinder head parts, at the first and second parting surfaces x6 and x7 of the lower cylinder head part, and/or at the parting surface x8 in the lower cylinder head part can be carried out by welding, and the following welding procedures can be employed:

1. For the parting surface x5 of the cylinder head, the first parting surface x6 of the lower cylinder head part, the second parting surface of the lower cylinder head part x7, and/or the parting surface x8 of the lower cylinder head part, putting a plate electrode between the connecting surfaces of two adjacent cylinder head parts to be welded, and the area of the plate electrode should cover the whole connecting surfaces; making the connecting surfaces of the cylinder head parts in close to the plate electrode; having the plate electrode energized and using the heat generated by the plate electrode to heat the connecting surfaces of the cylinder head parts on both sides; pulling out the plate electrode when the surfaces get to a proper molten state; then the connecting surfaces are welded together so as to form the whole cylinder head 80.

2. For the parting surface x5 of the cylinder head, the first parting surface x6 of the lower cylinder head part, the second parting surface of the lower cylinder head part x7, and/or the parting surface x8 of the lower cylinder head part, putting a strip electrode between the connecting surfaces of two adjacent cylinder head parts to be welded, and putting the strip electrode at one edge of the connecting surfaces, and the length of the strip electrode should cover and/or extend beyond the length of the connecting surfaces of the cylinder head; making the connecting surfaces on both sides of the parting surface in close to each other; having the strip electrode at one edge energized and using the heat generated by the strip electrode to heat a corresponding area of the connecting surfaces in close to the strip electrode; after the radial center of the strip electrode being aligned with the connecting surfaces in close to each other and making the strip electrode parallel to the parting surface of the cylinder head in the longitudinal direction, moving the strip electrode towards the cylinder head; the materials of the cylinder head will get molten as the strip electrode moves, and thereby welding together the cylinder head parts on both sides by the movement of the molten materials in the radial direction. Preferably, the connecting surfaces of the cylinder head can be arranged in a vertical orientation and in close to each other, in this case, the strip electrode is radially aligned with the connecting surface of the cylinder head parts, and is parallel to the parting surface of the cylinder head in the axial direction. The strip electrode is moved from bottom to top. The molten material of the cylinder head flows over the surface of the strip electrode and merges together under gravity by the movement of the molten materials in the radial direction, thereby welding the cylinder head parts together.

3. For the parting surface x5 of the cylinder head, the first parting surface x6 of the lower cylinder head part, the second parting surface of the lower cylinder head part x7, and/or the parting surface x8 of the lower cylinder head part, putting a round-shaped metal bar between the connecting surfaces of two adjacent cylinder head parts to be welded, and putting the round-shaped metal bar at one edge of the connecting surfaces, and the length of the round-shaped metal bar should cover and/or extend beyond the length of the connecting surfaces of the cylinder head; after the radial center of the round-shaped metal bar being aligned with the connecting surfaces in close to each other and making the round-shaped metal bar parallel to the parting surface of the cylinder head in the longitudinal direction, moving the round-shaped metal bar towards the cylinder head; the round-shaped metal bar being rotated in high speed and generating heat by friction with the connecting surfaces on both sides of the parting surface; the materials of the cylinder head will get molten by the heat generated by the rotated round-shaped metal bar, and thereby welding together the cylinder head parts on both sides by the movement of the molten materials in the radial direction. Preferably, the connecting surfaces of the cylinder head can be arranged in a vertical orientation and in close to each other, in this case, the round-shaped metal bar that is rotated in a high speed is radially aligned with the connecting surfaces of the cylinder head parts, and is parallel to the parting surface of the cylinder head in the axial direction. The round-shaped metal bar is moved from bottom to top. The molten material of the cylinder head flows over the surface of the round-shaped metal bar and merges together under gravity by the movement of the molten materials in the radial direction, thereby welding the cylinder head parts together.

4. For the parting surface x5 of the cylinder head, the first parting surface x6 of the lower cylinder head part, the second parting surface of the lower cylinder head part x7, and/or the parting surface x8 of the lower cylinder head part, putting a laser between the connecting surfaces of two adjacent cylinder head parts to be welded, and putting the laser at one edge of the connecting surfaces; after the radial center of the laser beam being aligned with the connecting surfaces in close to each other and making the laser beam parallel to the parting surface of the cylinder head in the longitudinal direction, moving the laser beam towards the cylinder head; the materials of the cylinder head will get molten as the laser beam moves, and thereby welding together the cylinder head parts on both sides after the radial movement of the laser. Preferably, the connecting surfaces of the cylinder head can be arranged in a vertical orientation and in close to each other, in this case, the laser beam is radially aligned with the connecting surface of the cylinder head parts, and is parallel to the parting surface of the cylinder head in the axial direction. The laser beam is moved from bottom to top. The molten material of the cylinder head merges together under gravity by the movement of the molten materials in the radial direction, thereby welding the cylinder head parts together.

The present invention can be further used for internal combustion engine cylinder head with a cam follower.

For example, in FIG. 19, the fuel injector receiving hole portion 876 is die-formed integrally with the lower cylinder head part 88, while the upper cylinder head part 87 is die-formed with a though hole for passing the fuel injector receiving hole portion 876, the fuel injector receiving hole portion 876 and the upper cylinder head part 87 are welded together by a weld 8031. Likewise, joints between the upper cylinder head part 87 and the intake valve stem receiving hole portion 8812, between the upper cylinder head part 87 and the exhaust valve stem receiving hole portion 8822 or between the upper cylinder head part 87 and the cam follower receiving hole portion 85 can be done by welding in similar welds. The upper cylinder head part 87 and lower cylinder head part 88 are welded together by an endless weld 8030 at their peripheral joint. The though hole 8762 for taking out mould core corresponds to the demoulding blind areas of the fuel injector receiving hole portion 876, exhaust duct 887 and/or exhaust duct 889, so that process-required inserts 8761 and 8891 are replaced by removable mould cores which can be drawn out, this is advantageous to attain a smooth cooling water flow in water cavity and an uniform casting wall thickness. The though hole 8762 for taking out core is closed with a sealing plug 8763. The two cam follower receiving holes 85 are communicated to each other and to lube oil supply by a lube oil passage 851. At the parting surface between the upper cylinder head part 87 and lower cylinder head part 88 and at the joint of the cam follower receiving hole portion 85, there is provided a weld 8034.

FIG. 20 shows another embodiment of the cylinder head of the present invention, in which cylinder head bolt holes 871 are cut open outward to be U-formed openings, which facilities to attain an endless weld 8030 at the peripheral joint between the upper cylinder head part 87 and the lower cylinder head part 88. The cylinder head bolt holes 871 can be cut U-formed outward open only at the portion near the endless weld 8030 between the upper cylinder head part 87 and the lower cylinder head part 88, while the other portion of the cylinder head bolt holes 871 and 881, that is, those under the two end faces of the cylinder head 80 still remain round holes so as to have better strength. The fuel injector receiving hole portion 876, the intake valve stem receiving hole portion 8812, the exhaust valve stem receiving hole portion 8822 and the cam follower receiving hole portions 85 are all welded together with the upper cylinder head part 87, respectively, by welds 8031, 8032, 8033 and 8034. The cam follower receiving hole portions 85 run through both the upper and lower cylinder head parts 87 and 88.

According to an alternative embodiment of that shown in FIG. 20, the cylinder head bolt hole portions correspond to the bolt hole portion 871 of the upper cylinder head part as shown at the upper left corner of FIG. 20. The bolt hole portion 871 of the upper cylinder head part is integrally die-cast formed with the lower cylinder head part 88, and is inserted through the corresponding through hole pre-formed in the upper cylinder head part 87, and then is welded to the upper cylinder head part 87 by a weld 8035. Finally, the upper cylinder head part 87 and the lower cylinder head part 88 are welded into the cylinder head 80 by a peripheral endless weld 803.

In the two embodiments of the multi-part cylinder head as shown in FIG. 20, it is unnecessary to provide O-rings 800 and/or adhesive sealants 802 for all the joints, and the welded surfaces are below any connecting surfaces of the cylinder head to other parts, so that they need no grinding or machining and hence being suitable to automatic mass production of the multi-part cylinder heads for water-cooled internal combustion engines. Further, FIG. 21 shows a still another embodiment of the cylinder head of the present invention, in which by inserting removable mould cores into the mould of the cylinder head, it is possible to directly form water cavity in the die casting blind areas, respectively, under the fuel injector receiving hole and under the exhaust and intake ducts by die-casting process. In FIG. 21, the removable mould cores 8764, 8765 and/or 8766, which are inserted respectively into the casing blind area under the fuel injector receiving hole, the casing blind area under the exhaust duct and the casing blind area under the intake duct, can be drawn out respectively during demoulding. After demoulding, the stepped holes 8768, 8769 and/or 8770 for the fuel injector receiving holes, the exhaust duct, and/or the intake duct, respectively, can all be closed and sealed with proper plugs 8763 respectively. Joining and sealing between the plugs and the stepped holes can be done by welding, adhering, bolting and/or riveting. In the case of employing bolting and/or riveting, the joints between the plugs and the stepped holes are applied with an adhesive sealant.

FIG. 22 is a sectional view taken along the line A-A in FIG. 21. As shown in FIG. 22, the removable mould core 8764 inserted in the casting blind area under the fuel injector receiving hole can be drawn out, and the stepped hole 8768 at the place of the fuel injector receiving hole is closed and sealed with a plug 8763.

FIG. 23 is a sectional view taken along the line B-B in FIG. 21. As shown in FIG. 23, the projecting body 8767 of the mould for the lower cylinder head part is in contact with the removable mould core 8765 inserted in the blind area under the exhaust duct during die-casting, and the removable mould core 8765 inserted in the blind area under the exhaust duct is drawn out during demoulding after finishing die-casting, so that the water hole 830 is communicated with the cylinder head water cavity 83, and cooling water can flow smoothly through the high temperature area between the intake and exhaust ducts and the bottom of the cylinder head.

FIGS. 24, 25 and 26 show yet another embodiment of the cylinder head 80 of the present invention, in which all joints between the upper cylinder head part 87 and the lower cylinder head part 88 are welded together without applying any adhesive sealants.

In FIG. 24, there is an endless weld 8036 along a line corresponding to the outer edge of the water cavity 83 in the lower cylinder head part 88. The fuel injector receiving hole portion 876, the intake valve stem receiving hole portion 8812 and the exhaust valve stem receiving hole portion 8822, which are formed together with the lower cylinder head part 88, are inserted through the corresponding through holes for the fuel injector receiving hole portion, for the intake valve stem receiving hole portion, and for the exhaust valve stem receiving hole portion in the upper cylinder head part 87 and are exposed at their end faces from the upper cylinder head part 87. On the top surface of the upper cylinder head part 87, there are welds 8031, 8032 and 8033 which are respectively around the fuel injector receiving hole portion 876, the intake valve stem receiving hole portion 8812 and the exhaust valve stem receiving hole portion 8822. The upper cylinder head part 87 and the lower cylinder head part 88 are joined into the cylinder head 80 by the welds 8036, 8031, 8032 and 8033. In this embodiment, both the cylinder head bolt holes 881 and cam follower receiving holes 85 are positioned outside the cylinder head water cavity 83 and the weld 8036 for the water cavity, and at the peripheral edge of the upper cylinder head part 87.

While it is explained as in the above that no adhesive sealant is necessary in this embodiment, it should be understood that it is practicable for the upper cylinder head part 87 in the embodiment not to employ welding joint but to employ adhesive sealants at the joints between the upper cylinder head part 87 and lower cylinder head part 88. The upper cylinder head part 87 and lower cylinder head part 88 can be joined into the whole cylinder head 80 by means of screw holes 888. Alternatively, it is practicable to use riveting joint instead of bolting joint. Even alternatively, it is also practicable to employ adhesive sealants but not fasteners to joint the upper cylinder head part 87 and lower cylinder head part 88 into the whole cylinder head 80. In the embodiment, the upper cylinder head part 87 and the lower cylinder head part 88 can be joined into the whole cylinder head 80 by welding, adhering, bolting and/or riveting in combination.

FIG. 25 is a sectional view taken along the line A-A in FIG. 24. It shows that the fuel injector receiving hole portion 876, which is formed together with the lower cylinder head part 88, is inserted through a corresponding through hole in the upper cylinder head part 87 and exposed at its end face from the upper cylinder head part 87. The upper cylinder head part 87 and the lower cylinder head part 88 are joined into the whole cylinder head 80 by both the weld 8031 around the fuel injector receiving hole portion 876 and the endless weld 8036 along the outside of the cylinder head water cavity 83 of the lower cylinder head 88.

FIG. 26 is a sectional view taken along the line C-C in FIG. 24. It shows that the exhaust valve stem receiving hole portion 8822, which is formed together with the lower cylinder head part 88, is inserted through a corresponding through hole in the upper cylinder head part 87 and exposed at its end face from the upper cylinder head. The upper cylinder head part 87 and the lower cylinder head part 88 are joined into the whole cylinder head 80 by both the weld 8033 around the exhaust valve stem receiving hole portion 8822 and the endless weld 8036 along the outside of the cylinder head water cavity 83. The weld 8032 around the intake valve stem receiving hole 8812 portion can be arranged in the same way as shown in this figure.

The upper cylinder head part 87 as shown in FIGS. 24, 25 and 26, including the upper cylinder head part according to other embodiments, can be made of a metal plate. In the case of manufacturing upper cylinder head part 87 by use of a metal plate, the whole cylinder head water cavity 83 is formed in the lower cylinder head part 88.

In FIG. 27, a non-adhesive sealant 806 is applied in the connecting surface between the lower sub-part 8818 and the upper sub-part 8819 of the lower cylinder head part 88. An adequate sealing can be realized when the two sub-parts are fastened together. An adhesive sealant 802 is applied in the connection between the screw hole 888 and through hole 882. O-rings 883 are provided at the connection between the upper cylinder head part 87 and the upper sub-part 8819 of the lower cylinder head part 88. Here is shown an embodiment in which various sealing means are employed in combination.

In FIG. 28, the cylinder head bolt hole portions 881, the fuel injector receiving hole portion 876, the intake valve stem receiving hole portion 8812 and the exhaust valve stem receiving hole portion 8822, which are all formed together with the lower cylinder head part 88, are all inserted through the corresponding through holes for the cylinder head bolt hole portions, for the fuel injector receiving hole portion, for the intake valve stem receiving hole portion, and for the exhaust valve stem receiving hole portion in the upper cylinder head part 87 and are exposed at their end faces from the upper cylinder head part 87. The intake and exhaust ducts 887 and 889 formed together with the lower cylinder head part 88 correspond to the intake and exhaust duct through holes formed in the upper cylinder head part 87 respectively. On the upper cylinder head part 87, there are welds 8035 around the cylinder head bolt hole portions 881, weld 8031 around the fuel injector receiving hole portion 876, weld 8032 around the intake valve stem receiving hole portion 8812, weld 8033 around the exhaust valve stem receiving hole portion 8822, and welds 8037 around the intake and exhaust ducts. At the joint between the lower portion of the upper cylinder head part 87 and bottom of the lower cylinder head part 88, there is an endless peripheral weld 8030. The upper cylinder head part 87 and the lower cylinder head part 88 are joined into the whole cylinder head 80 by all the welds 8030, 8031, 8032, 8033, 8035 and 8037. A draft angle $\alpha$ facilitates to make a weld 8037 between the intake and exhaust ducts on the lower cylinder head part 88 and the corresponding through holes for the intake and exhaust ducts on the upper cylinder head part 87. When forming a lower cylinder head part 88 configured as described above by die-casting process, the intake duct, the exhaust duct, the fuel injector receiving hole portion and cylinder head bolt hole portions are all exposed above the bottom of the cylinder head water cavity 83, it is convenient for demoulding and drawing out the mould cores in several directions. The joint between the bottom of the cylinder head and the intake and exhaust ducts is sealed by the weld 8030 without employing plugs 8763, which is advantageous to improve integrity and appearance of a cylinder head composed of the upper cylinder head part 87 and the lower cylinder head part 88. The intake duct and the exhaust duct are disposed systematically and joined by the same means, therefore in this figure, only is shown a section of intake duct 887 in the lower cylinder head part 88 and the corresponding through hole in the upper cylinder head part 87 as well as their weld 8037, the section view of the exhaust duct is omitted. Because the cylinder head bolt hole portions, the fuel injector receiving hole portion and the intake and exhaust duct portions are all formed together with the lower cylinder head part, the lower cylinder head part 88 can meet the design requirements to bear the force generated by tightening cylinder head bolts, high temperature and shock and vibration. The upper cylinder head part 87 in this embodiment can be formed by stamping process. In the case that this embodiment is applied to a cylinder head with cam follower receiving holes, the cam follower receiving hole portions can also be formed together with the lower cylinder head part 88 and joined to the upper cylinder head part 87 in the same way as described for the cylinder head bolt holes.

Furthermore, the embodiment in which the joints between the upper cylinder head part 87 and the lower cylinder head part 88 are joined and sealed by welding without any adhesive sealant can be modified to employ adhesive sealants to join the upper cylinder head part 87 and the lower cylinder head part 88 into the whole cylinder head 80. Alternatively, the upper cylinder head part 87 and the lower cylinder head part 88 can be joined into the whole cylinder head 80 partially by welding and partially by adhering. Alternatively, the upper cylinder head part 87 and the lower cylinder head part 88 can be joined into the whole cylinder head 80 by a combination of bolting, riveting, welding and/or adhering. The present invention is applicable to water-cooled single-cylinder and multi-cylinder internal combustion engines, and hence both of them fall in the scope of the present invention.

The invention claimed is:

1. A water-cooled internal combustion engine cylinder head, said cylinder head comprising: an intake duct, an exhaust duct, a cylinder head water cavity, a fuel injector receiving hole, an intake valve stem receiving hole, and an exhaust valve stem receiving hole, characterized in that, said cylinder head is formed by integrating an upper cylinder head part and a lower cylinder head part, which are manufactured separately, into the whole, wherein said fuel injector receiving hole, said intake valve stem receiving hole and said exhaust valve stem receiving hole are respectively formed by integrating their upper portions which are formed together with said upper cylinder head part and their lower portions which are formed together with said lower cylinder head part respectively; said intake duct and said exhaust duct are formed in said lower cylinder head part; said cylinder head water cavity is formed by integrating an upper water cavity portion which is formed together with said upper cylinder head part and a lower water cavity portion which is formed together with said lower cylinder head part into the whole, alternatively, said cylinder head water cavity is formed, as a whole, with said lower cylinder head part, wherein the joints between said upper cylinder head part and said lower cylinder head part are all integrated and sealed by welding without employing an adhesive sealant, wherein said cylinder head further comprises cam follower receiving holes, said cylinder head is formed by integrating said upper cylinder head part and said lower cylinder head part, which are manufactured separately, into the whole, said upper cylinder head part is provided with through holes for inserting therethrough the fuel injector receiving hole portion, the intake valve stem receiving hole portion and the exhaust valve stem receiving hole portion, respectively, all of which are formed together with said lower cylinder head part, and said lower cylinder head part is provided with the intake duct, the exhaust duct, the cylinder head water cavity, the fuel injector receiving hole, the intake valve stem receiving hole and the exhaust valve stem receiving hole; said cam follower receiving holes are formed of an upper portion formed together with said upper cylinder head part and a lower portion formed together with said lower cylinder head part; around the periphery of a parting surface between said upper cylinder head part and said lower cylinder head part is provided a first endless weld which runs inside of the cylinder head bolt holes; at the joint between said fuel injector receiving hole which is formed together with said lower cylinder head part and the corresponding through hole in said upper cylinder head part is provided a second weld; at the joint between said intake valve stem receiving hole which is formed together with said lower cylinder head part and the corresponding through hole in said upper cylinder head part is provided a third weld; at the joint between said exhaust valve stem receiving hole which is formed together with said lower cylinder head part and the corresponding through hole in said upper cylinder head part is provided a fourth weld, and at the parting surface between said upper cylinder head part and said lower cylinder head part and around said cam follower receiving holes are provided fifth welds, said upper cylinder head part and said lower cylinder head part are integrated into said cylinder head by said first weld, said second weld, said third weld, said fourth weld and said fifth welds.

2. The cylinder head according to claim 1, wherein an outside wall of said cylinder head is provided with windows for drawing out mould cores, which correspond to the demoulding blind areas of said fuel injector receiving hole, said intake duct and/or said exhaust duct by die-casting process, and with plugs for closing said windows.

3. The cylinder head according to claim 1, wherein when forming said cylinder head by a die-casting process, a first removable mould core piece is inset in the casting blind area under said fuel injector receiving hole, a second removable mould core piece is inset in the casting blind area under said exhaust duct and/or a removable mould core piece is inset in the casting blind area under said intake duct; during demoulding, said removable mould core pieces, as inset in said casting blind areas under said fuel injector receiving hole, under said exhaust duct and/or under said intake duct respectively, are drawn out; stepped holes, corresponding to said fuel injector receiving hole, said exhaust duct and said intake duct respectively, are closed with plugs corresponding to the shapes of the stepped holes respectively, the connection between said plugs and said stepped holes is attained by welding, adhering, bolting and/or riveting.

4. The cylinder head according to claim 1, wherein said intake valve stem receiving hole and said exhaust valve stem receiving hole are inset with an intake valve stem guide sleeve and an exhaust valve stem guide sleeve respectively.

5. The cylinder head according to claim 1, wherein said cylinder head is formed by integrating said upper cylinder head part and said lower cylinder head part, which are manufactured separately, into the whole, in the case that said upper cylinder head part and said lower cylinder head part are integrated, the fuel injector receiving hole portion, the intake valve stem receiving hole portion and the exhaust valve stem receiving hole portion, all of which are formed together with said lower cylinder head part, are inserted respectively through the corresponding holes which are formed in said upper cylinder head part respectively, and are exposed from the top surface of said upper cylinder head part; at the parting surface between said upper cylinder head part and said lower cylinder head part and outside said cylinder head water cavity, is provided a first endless weld; said fuel injector receiving hole, said intake valve stem receiving hole and said exhaust valve stem receiving hole are welded to said upper cylinder head part by a second endless weld, a third endless weld and a fourth endless weld respectively; said upper cylinder head part and said lower cylinder head part are integrated into said cylinder head by said first endless weld, said second endless weld of the fuel injector receiving hole, said third endless weld of the intake valve stem receiving hole and said fourth endless weld of the exhaust valve stem receiving hole.

6. The cylinder head according to claim 1, wherein said cam follower receiving holes are formed by integrating an upper portion formed together with said upper cylinder head part and a lower portion formed together with said lower cylinder head part.

7. A water-cooled internal combustion engine comprising a cylinder block and the cylinder head according to claim 1.

8. A machine equipped with the water-cooled internal combustion engine head according to claim 1.

9. A water-cooled internal combustion engine cylinder head, said cylinder head comprising: an intake duct, an exhaust duct, a cylinder head water cavity, a fuel injector receiving hole, an intake valve stem receiving hole, and an exhaust valve stem receiving hole, characterized in that, said cylinder head is formed by integrating an upper cylinder head part and a lower cylinder head part, which are manufactured separately, into the whole, wherein said fuel injector receiving hole, said intake valve stem receiving hole and said exhaust valve stem receiving hole are respectively formed by integrating their upper portions which are formed together with said upper cylinder head part and their lower portions which are formed together with said lower cylinder head part respectively; said intake duct and said exhaust duct are formed in said lower cylinder head part; said cylinder head water cavity is formed by integrating an upper water cavity portion which is formed together with said upper cylinder head part and a lower water cavity portion which is formed together with said lower cylinder head part into the whole, alternatively, said cylinder head water cavity is formed, as a whole, with said lower cylinder head part, wherein the joints between said upper cylinder head part and said lower cylinder head part are all integrated and sealed by welding without employing an adhesive sealant, wherein said cylinder head further comprises cam follower receiving holes, and said cylinder head is formed by integrating said upper cylinder head part and said lower cylinder head part, which are manufactured separately, into the whole, said upper cylinder head part is provided with through holes for inserting therethrough the fuel injector receiving hole portion, the intake valve stem receiving hole portion, the exhaust valve stem receiving hole portion and the cylinder head bolt hole portions, respectively, all of which are formed together with said lower cylinder head part, and said lower cylinder head part is provided with the intake duct, the exhaust duct, the cylinder head water cavity, the fuel injector receiving hole, the cylinder head bolt hole portions, the intake valve stem receiving hole portion and the exhaust valve stem receiving hole portion; said cam follower receiving holes are formed of an upper portion formed together with said upper cylinder head part and a lower portion formed together with said lower cylinder head part; around the periphery of a parting surface between said upper cylinder head said part and said lower cylinder head part is provided a first endless weld; at the joint between said fuel injector receiving hole which is formed together with said lower cylinder head part and the corresponding through hole in said upper cylinder head part is provided a second weld; at the joint between said intake valve stem receiving hole which is formed together with said lower cylinder head part and the corresponding through hole in said upper cylinder head part is provided a third weld; at the joint between said exhaust valve stem receiving hole which is formed together with said lower cylinder head part and the corresponding through hole in said upper cylinder head part is provided a fourth weld; and at the parting surface between said upper cylinder head part and said lower cylinder head part and around said cam follower receiving holes are provided fifth welds; at the joints between said cylinder head bolt holes and the corresponding through holes in said upper cylinder head part are provided sixth welds, and said upper cylinder head part and said lower cylinder head part are integrated into said cylinder head by said first endless weld, said second weld, said third weld, said fourth weld, said fifth welds and said sixth welds.

10. The cylinder head according to claim 9, wherein an outside wall of said cylinder head is provided with windows for drawing out mould cores, which correspond to the demoulding blind areas of said fuel injector receiving hole, said intake duct and/or said exhaust duct by die-casting process, and with plugs for closing said windows.

11. The cylinder head according to claim 9, wherein when forming said cylinder head by a die-casting process, a first removable mould core piece is inset in the casting blind area under said fuel injector receiving hole, a second removable mould core piece is inset in the casting blind area under said exhaust duct and/or a removable mould core piece is inset in the casting blind area under said intake duct; during demoulding, said removable mould core pieces, as inset in said casting blind areas under said fuel injector receiving hole, under said exhaust duct and/or under said intake duct respectively, are drawn out; stepped holes, corresponding to said fuel injector receiving hole, said exhaust duct and said intake duct respectively, are closed with plugs corresponding to the shapes of the stepped holes respectively, the connection between said plugs and said stepped holes is attained by welding, adhering, bolting and/or riveting.

12. The cylinder head according to claim 9, wherein said intake valve stem receiving hole and said exhaust valve stem receiving hole are inset with an intake valve stem guide sleeve and an exhaust valve stem guide sleeve respectively.

13. A water-cooled internal combustion engine cylinder head, said cylinder head comprising: an intake duct, an exhaust duct, a cylinder head water cavity, a fuel injector receiving hole, an intake valve stem receiving hole, and an exhaust valve stem receiving hole, characterized in that, said cylinder head is formed by integrating an upper cylinder head part and a lower cylinder head part, which are manufactured separately, into the whole, wherein said fuel injector receiving hole, said intake valve stem receiving hole and said exhaust valve stem receiving hole are respectively formed by integrating their upper portions which are formed together with said upper cylinder head part and their lower portions which are formed together with said lower cylinder head part respectively; said intake duct and said exhaust duct are formed in said lower cylinder head part; said cylinder head water cavity is formed by integrating an upper water cavity portion which is formed together with said upper cylinder head part and a lower water cavity portion which is formed together with said lower cylinder head part into the whole, alternatively, said cylinder head water cavity is formed, as a whole, with said lower cylinder head part, wherein the joints between said upper cylinder head part and said lower cylinder head part are all integrated and sealed by welding without employing an adhesive sealant, wherein in the case that said upper cylinder head part and said lower cylinder head part are integrated, the cylinder head bolt hole portions, the fuel injector receiving hole, the intake valve stem receiving hole and the exhaust valve stem receiving hole, all of which are formed together with said lower cylinder head part, are inserted respectively through the corresponding through holes which are formed on said upper cylinder head part respectively, and are exposed from the top surface of said upper cylinder head part, and said intake duct and said exhaust duct, both of which are formed together with said lower cylinder head part, correspond to the intake duct through hole and the exhaust duct through hole which are formed in said upper cylinder head part respectively; on said upper cylinder head part there are endless welds which weld the cylinder head bolt hole portions, the fuel injector receiving hole portion, the intake valve stem receiving hole portion and the exhaust valve stem receiving hole portion on said upper cylinder head part respectively; furthermore, on said upper cylinder head part there are second group of endless welds which weld the intake and exhaust ducts to said upper cylinder head part; and at the joint between the lower portion of said upper cylinder head part and the bottom of said lower cylinder head part is provided a third endless weld—, said upper cylinder head part and said lower cylinder head part are integrated into said cylinder head by all said welds, said endless weld for the fuel injector receiving hole, said endless weld for the intake valve stem receiving hole, said endless weld for the exhaust valve stem receiving hole, said endless weld for the cylinder head bolt holes and said endless weld for the intake/exhaust duct.

14. The cylinder head according to claim 13, wherein said intake valve stem receiving hole and said exhaust valve stem receiving hole are inset with an intake valve stem guide sleeve and an exhaust valve stem guide sleeve respectively.

15. The cylinder head according to claim 13, wherein an outside wall of said cylinder head is provided with windows for drawing out mould cores, which correspond to the demoulding blind areas of said fuel injector receiving hole, said intake duct and/or said exhaust duct by die-casting process, and with plugs for closing said windows.

16. The cylinder head according to claim 13, wherein when forming said cylinder head by a die-casting process, a first removable mould core piece is inset in the casting blind area under said fuel injector receiving hole, a second removable mould core piece is inset in the casting blind area under said exhaust duct and/or a third removable mould core piece is inset in the casting blind area under said intake duct; during demoulding, said removable mould core pieces, as inset in said casting blind areas under said fuel injector receiving hole, under said exhaust duct and/or under said intake duct respectively, are drawn out; stepped holes, corresponding to said fuel injector receiving hole, said exhaust duct and said intake duct respectively, are closed with plugs corresponding to the shapes of the stepped holes respectively, the connection between said plugs and said stepped holes is attained by welding, adhering, bolting and/or riveting.

17. The cylinder head according to claim 13, wherein said cylinder head is formed by integrating said upper cylinder head part and said lower cylinder head part, which are manufactured separately, into the whole, in the case that said upper cylinder head part and said lower cylinder head part are integrated, the fuel injector receiving hole portion, the intake valve stem receiving hole portion and the exhaust valve stem receiving hole portion, all of which are formed together with said lower cylinder head part, are inserted respectively through the corresponding through holes which are formed in said upper cylinder head part respectively, and are exposed from the top surface of said upper cylinder head part; at the parting surface between said upper cylinder head part and said lower cylinder head part and outside said cylinder head water cavity, is provided a first endless weld; said fuel injector receiving hole, said intake valve stem receiving hole and said exhaust valve stem receiving hole are welded to said upper cylinder head part by a second endless weld, a third endless weld and a fourth endless weld respectively; said upper cylinder head part and said lower cylinder head part are integrated into said cylinder head by said first endless weld, said second endless weld of the fuel injector receiving hole, said third endless weld of the intake valve stem receiving hole and said fourth endless weld of the exhaust valve stem receiving hole.

18. The cylinder head according to claim 13, wherein said cylinder head further comprises cam follower receiving holes, said cam follower receiving holes are formed by integrating an upper portion formed together with said upper cylinder head part and a lower portion formed together with said lower cylinder head part.

19. A water-cooled internal combustion engine comprising a cylinder block and the cylinder head according to claim 13.

20. A machine equipped with the water-cooled internal combustion engine according to claim 19.

* * * * *